United States Patent [19]

Sakai et al.

[11] Patent Number: 5,035,986

[45] Date of Patent: Jul. 30, 1991

[54] SILVER HALIDE COLOR PHOTOGRAPHIC MATERIAL

[75] Inventors: Nobuo Sakai; Shigeru Ohno, both of Kanagawa, Japan

[73] Assignee: Fuji Photo Film Co., Ltd., Kanagawa, Japan

[21] Appl. No.: 303,204

[22] Filed: Jan. 30, 1989

[51] Int. Cl.[5] ..... G03C 1/825

[52] U.S. Cl. ..... 430/522; 430/550; 430/571; 430/572; 430/582; 430/583; 430/588; 430/595

[58] Field of Search ..... 430/583, 582, 571, 572, 430/550, 588, 522, 595

[56] References Cited

U.S. PATENT DOCUMENTS

| | | | |
|---|---|---|---|
| 3,247,127 | 3/1961 | Bailey | 252/300 |
| 3,469,985 | 9/1969 | Bailey | 96/84 |
| 4,078,933 | 3/1978 | Sugiyama et al. | 96/84 |
| 4,564,591 | 1/1986 | Tanaka et al. | 430/567 |
| 4,590,155 | 5/1986 | Klotzer | 430/567 |
| 4,605,610 | 8/1986 | Klotzer | 430/376 |
| 4,833,246 | 5/1989 | Adachi et al. | 544/82 |

FOREIGN PATENT DOCUMENTS

| | | |
|---|---|---|
| 273430 | 6/1988 | European Pat. Off. . |
| 55-161233 | 12/1980 | Japan . |
| 59-111640 | 6/1984 | Japan . |
| 62-275246 | 11/1987 | Japan . |
| 63-262649 | 10/1988 | Japan . |
| 506385 | 6/1939 | United Kingdom . |
| 1177429 | 1/1970 | United Kingdom . |
| 1311884 | 3/1973 | United Kingdom . |
| 1338799 | 11/1973 | United Kingdom . |
| 1373026 | 6/1974 | United Kingdom . |
| 1385371 | 2/1975 | United Kingdom . |
| 1433102 | 4/1976 | United Kingdom . |
| 1467214 | 3/1977 | United Kingdom . |
| 1553516 | 9/1979 | United Kingdom . |

OTHER PUBLICATIONS

Chemical Abstracts 109:46086e–Abstract; Hirabayashi, S.; Sato, K., "Silver Halide Color Photographic Materials Containing Antihalation Dye", (1988).

*Primary Examiner*—Charles L. Bowers, Jr.
*Assistant Examiner*—Janis A. Dote
*Attorney, Agent, or Firm*—Sughrue, Mion, Zinn, Macpeak & Seas

[57] ABSTRACT

A silver halide color photographic material comprising photographic constituent layers containing at least one light-sensitive silver halide emulsion layer and at least one light-insensitive layer on a reflective support, wherein at least one of the photographic constituent layers comprises at least one dye represented by formula (I), at least one of the light-sensitive silver halide emulsion layers comprises silver halide grains substantially comprising silver chloride and the reflective support comprises 3.0 g/m$^2$ or more of titanium oxide:

(I)

wherein $R_1$ and $R_2$ each represents an alkyl group, an aryl group, a cyano group, —$COOR_5$, —$CONR_5R_6$, —$COR_7$, —$SO_2R_7$, —$SOR_7$, —$SO_2NR_5R_6$, —$OR_5$, —$NR_5R_6$, —$NR_6COR_7$, —$NR_5CONR_5R_6$ or —$NR_6SO_2R_7$ in which $R_5$ and $R_6$ each represents a hydrogen atom, an alkyl group or an aryl group, $R_7$ represents an alkyl group or an aryl group, and $R_5$ and $R_6$ or $R_6$ and $R_7$ may be connected to eachother to form a 5- or 6-membered ring; $R_3$ and $R_4$ each represents a hydrogen atom or an alkyl group; $Q_1$ and $Q_2$ each represents an aryl group; $X_1$ and $X_2$ each represents a bond or divalent connecting group; $Y_1$ and $Y_2$ each represents a sulfo group or a carboxyl group; $L_1$, $L_2$ and $L_3$ each represents a substituted or unsubstituted methine group; n represents an integer 0, 1 or 2; $m_1$ and $m_2$ each represents an integer 1 or 2; $p_1$ and $p_2$ each represents an integer 0, 1, 2, 3 or 4; and $q_1$ and $q_2$ each represents an integer 1, 2 or 3.

10 Claims, No Drawings

SILVER HALIDE COLOR PHOTOGRAPHIC MATERIAL

FIELD OF THE INVENTION

The present invention relates to a silver halide color photographic material. More particularly, the present invention relates to a silver halide color photographic material which can be rapidly processed, is less susceptible to dye stain and exhibits high sharpness.

BACKGROUND OF THE INVENTION

In the process for the formation of color images on the ordinary silver halide color photographic material, the light-sensitive material is imagewise exposed to light, and an oxidation product of a p-phenylenediamine color developing agent and a dye-forming coupler is then allowed to undergo reaction in the light-sensitive material to form color images. In this process, the subtractive color reproduction process is normally employed so that a cyan dye, a magenta dye and a yellow dye are formed in the respective light-sensitive layers in correspondence to red light, green light and blue light, respectively.

In recent years, such a color image formation process has tended to reduce the development time by employing the high temperature development process or saving labor at processing steps. Particularly, in order to reduce the development time by employing the high temperature development, it is extremely important to increase the rate of development in the color development. The rate of development in the color development is affected by two factors. One of the two factors is a silver halide color photographic material, and the other a color developing solution.

In the former factor, the crystal structure, size and halogen composition of the light-sensitive silver halide grains to be incorporated in the photographic emulsion greatly affect the rate of development. In the latter factor, the rate of development is subject to affects by the conditions of the color developing solution, especially the type of the development inhibitor to be used. It has been known that silver chloride grains exhibit a remarkably high rate of development under specific conditions.

A silver halide color photographic material wherein silver halide grains substantially comprise silver chloride can be rapidly processed. Such a silver halide color photographic material can be developed even in as short a period of time as 90 seconds or less. However, such a silver halide color photographic material has been newly found to be disadvantageous in that it is subject to dye stain after being processed.

As a result of studies on dye stain, the inventors found that an antiirradiation dye incorporated in the light-sensitive material insufficiently diffuses into the processing solution or discolors upon the short time processing, leaving some part thereof in the light-sensitive material after being processed.

It may be proposed to inhibit dye stain by reducing the amount of the antiirradiation dye to be used. In this case, however, the sharpness of images, which is the object of the antiirradiation dye, can be deteriorated.

As described above, various problems must be solved in order to provide a silver halide color photographic material comprising silver halide grains substantially made of silver chloride which can be rapidly processed, is less subject to dye stain and can form dye images having a high sharpness. Thus, it has been keenly desired to provide a silver halide color photographic material which meets these requirements.

SUMMARY OF THE INVENTION

It is therefore an object of the present invention to provide a silver halide color photographic material which can be rapidly processed, can form images having an excellent sharpness and is less subject to dye stain after being developed.

The above and other objects of the present invention will become more apparent from the following detailed description and examples.

These objects of the present invention are accomplished with a silver halide color photographic material comprising photographic constituent layers containing at least one light-sensitive silver halide emulsion layer and at least one light-insensitive layer on a reflective support, wherein at least one of said photographic constituent layers comprises at least one dye represented by formula (I), at least one of said light-sensitive silver halide emulsion layers comprises silver halide grains substantially comprising silver chloride and said reflective support comprises 3.0 g/m$^2$ or more of titanium oxide:

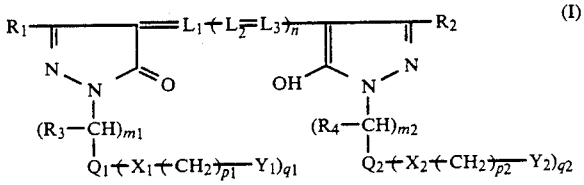

(I)

wherein $R_1$ and $R_2$ each represents an alkyl group, an aryl group, a cyano group, —$COOR_5$, —$CONR_5R_6$, —$COR_7$, —$SO_2R_7$, —$SOR_7$, —$SO_2NR_5R_6$, —$OR_5$, —$NR_5R_6$, —$NR_6COR_7$, —$NR_5CONR_5R_6$ or —$NR_6SO_2R_7$ in which $R_5$ and $R_6$ each represents a hydrogen atom, an alkyl group or an aryl group, $R_7$ represents an alkyl group or an aryl group, and $R_5$ and $R_6$ or $R_6$ and $R_7$ may be connected to each other to form a 5- or 6-membered ring; $R_3$ and $R_4$ each represents a hydrogen atom or an alkyl group; $Q_1$ and $Q_2$ each represents an aryl group; $X_1$ and $X_2$ each represents a bond or divalent connecting group; $Y_1$ and $Y_2$ each represents a sulfo group or a carboxyl group; $L_1$, $L_2$ and $L_3$ each represents a substituted or unsubstituted methine group; n represents an integer 0, 1 or 2; $m_1$ and $m_2$ each represents an integer 1 or 2; $p_1$ and $p_2$ each represents an integer 0, 1, 2, 3 or 4; and $q_1$ and $q_2$ each represents an integer 1, 2 or 3.

DETAILED DESCRIPTION OF THE INVENTION

The light-sensitive silver halide emulsion to be incorporated in the present silver halide color photographic material substantially comprises silver chloride grains. The term "silver halide grains substantially comprising silver chloride" as used herein means silver halide grains having a silver chloride content (average value) of 80 mol % or more, preferably 90 mol % or more, more preferably 95 mol % or more, and particularly 98 mol % or more.

The present silver halide emulsion may comprise silver bromide and/or silver iodide as other silver halide compositions than silver chloride. In this case, silver bromide may be contained in an amount of 20 mol % or less, preferably 5 mol % or less. If silver iodide is present, silver iodide may be normally incorporated in an amount of 1 mol % or less, preferably 0.5 mol % or less, particularly 0 mol %. It is most preferred to employ a silver halide emulsion comprising silver chlorobromide grains having the silver chloride content of 98 mol % or more, particularly from 98.0 to 99.9 mol %.

The present silver halide emulsion substantially comprising silver chloride may be mixed with (an)other type(s) of silver halide emulsion. In an embodiment of the mixed emulsion, the present silver halide grains substantially comprising silver chloride is preferably present in an amount of 80% by weight or more of the total silver halide grains. However, it is most preferred that the present silver halide emulsion substantially comprising silver chloride is incorporated alone in a silver halide emulsion layer.

The present silver halide color photographic material may consist of two or more light-sensitive silver halide emulsion layers. At least one of these light-sensitive silver halide emulsion layers needs to be a silver halide emulsion layer containing silver halide grains substantially comprising silver chloride.

The silver halide composition of the other light-sensitive silver halide emulsion layers is not specifically limited but may preferably comprise silver chlorobromide grains or silver chlorobromide grains having a silver chloride content of at least 50 mol %. The amount of silver bromide and silver iodide to be incorporated in the present silver halide color photographic material is preferably in the range of 30 mol % or less, particularly about 10 mol % or less based on the total amount of the silver halide emulsion.

The present silver halide may be prepared by any one of an ammonia process, a neutral process and an acid process. The present silver halide may also be prepared by any one of a simultaneous mixing process, a forward mixing process, a reversal mixing process and a conversion process.

The crystal structure of the present silver halide grains may be such that the inner portion and the outer portion have different phases, may be a multilayer structure having a junction structure or may be such that the entire grain is composed of a uniform phase. Alternatively, the present silver halide grains may have a mixture of these phases.

The average particle size of the present silver halide grains is preferably in the range of 0.1 to 2 μm, particularly 0.15 to 1 μm as calculated in terms of the diameter of the grain if it is spherical or near spherical or the side length if it is cubic, represented by the mean value based on the projected area. The particle size distribution may be narrow or wide. A monodispersed silver halide emulsion may be preferably used wherein 90% or more, particularly 95% or more, of the total grains fall within ±40% (preferably ±20%) of the average particle size as calculated by the weight or number of grains.

In order to provide a gradation required by the light-sensitive material, two or more monodispersed emulsions of silver halide grains having different particle size may be preferably coated in admixture on the same layer or separately on a plurality of layers in an emulsion layer having substantially the same color sensitivity. Alternatively, two or more polydispersed silver halide emulsions or a combination of a monodispersed emulsion and a polydispersed emulsion may be coated in admixture on the same layer or separately on a plurality of layers.

The crystal structure of the silver halide grain to be used in the present invention may be preferably a regular crystal structure such as cube, octahedron, dodecahedron or tetradecahedron, particularly cube or tetradecahedron. Alternatively, the present silver halide grains may be tabular grains. Particularly, an emulsion wherein tabular grains having a length/thickness ratio of 5 or more, preferably 8 or more, account for 50% or more of the total grains by projected area may be used. The present silver halide emulsion may comprise a mixture of these various crystal structures. The present silver halide emulsion may be of the surface latent image type in which latent images are formed mainly on the surface of grains or the internal latent image type in which latent images are formed mainly inside grains. The latter type of a silver halide emulsion may be particularly preferably used as an emulsion for forming direct positive images.

The present silver halide emulsion is normally subjected to physical ripening, chemical ripening and spectral sensitization before use. The additives to be used in such a process are described in *Research Disclosure,* Nos. 17643 and 18716. The places where such a description is found are summarized in the table below.

These two *Research Disclosure* issues also describe known photographic additives which can be used in the present invention. The places where such a description is found are summarized in the table below.

| Additives | RD 17643 | RD 18716 |
|---|---|---|
| 1. Chemical Sensitizer | Page 23 | Page 648, right column |
| 2. Sensitivity Improver | | Page 648, right column |
| 3. Spectral Sensitizer, Supersensitizer | Pages 23–24 | Page 648, right column to page 649, right column |
| 4. Brightening Agent | Page 24 | |
| 5. Fog Inhibitor, Stabilizer | Pages 24–25 | Page 649, right column |
| 6. Light Absorber, Filter Dye, Ultraviolet Absorber | Pages 25–26 | Page 649, right column to page 650, left column |
| 7. Stain Inhibitor | Page 25, right column | Page 650, left to right columns |
| 8. Dye Stabilizer | Page 25 | |
| 9. Film Hardener | Page 26 | Page 651, left column |
| 10. Binder | Page 26 | Page 651, left column |
| 11. Plasticizer, Lubricant | Page 27 | Page 650, right column |
| 12. Coating Aid, Surface Active Agent | Pages 26–27 | Page 650, right column |
| 13. Antistatic Agents | Page 27 | Page 650, right column |

The dye represented by formula (I) will be further described hereinafter. Preferred examples of the alkyl group represented by $R_1$, $R_2$, $R_5$, $R_6$ and $R_7$ include an alkyl group containing from 1 to 8 carbon atoms (e.g., methyl, ethyl, n-propyl, isopropyl, n-butyl, isobutyl, t-butyl, n-amyl, n-hexyl, n-octyl, isoamyl). These alkyl groups may contain substituents such as a halogen atom (e.g., fluorine, chlorine, bromine), a phenyl group, a hydroxyl group, a cyano group, an alkoxy group (e.g., methoxy, ethoxy, hydroxyethoxy), an aryloxy group (e.g., phenoxy, p-methoxyphenoxy), a carboxyl group, a sulfo group, an amino group or a substituted amino group (e.g., dimethylamino, diethylamino).

Preferred examples of the alkyl group represented by $R_3$ and $R_4$ include an alkyl group containing 4 or less carbon atoms (e.g., methyl, ethyl, n-propyl).

Preferred examples of the aryl group represented by $R_1$, $R_2$, $R_5$, $R_6$ and $R_7$ include a phenyl group and a naphthyl group. These aryl groups may contain substituents such as a halogen atom (e.g., fluorine, chlorine, bromine), a sulfo group, a carboxy group, a hydroxyl group, a cyano group, an alkyl group containing from 1 to 4 carbon atoms (e.g., methyl, ethyl, n-propyl), an alkoxy group (e.g., methoxy, ethoxy) or an aryloxy group (e.g., phenoxy).

Preferred examples of the aryl group represented by $Q_1$ and $Q_2$ include a phenyl group and a naphthyl group. These aryl groups may contain substituents other than a sulfo group and a carboxyl group, such as an alkyl group containing from 1 to 4 carbon atoms (e.g., methyl, ethyl), an alkoxy group (e.g., methoxy, ethoxy), a halogen atom (e.g., fluorine, chlorine, bromine), a carbamoyl group (e.g., methylcarbamoyl, ethylcarbamoyl), a sulfamoyl group (e.g., ethylsulfamoyl), a cyano group, a nitro group, an alkylsulfonyl group (e.g., methanesulfonyl), an arylsulfonyl group (e.g., benzenesulfonyl), an amino group (e.g., dimethylamino, diethylamino), an acylamino group (e.g., acetylamino), a sulfonamide group (e.g., methanesulfonamide) or a hydroxyl group.

Examples of the divalent connecting group represented by $X_1$ and $X_2$ include —O—, —$NR_8$—, —$NR_8CO$—, —$SO_2$—, and —$NR_8SO_2$— wherein $R_8$ represents a hydrogen atom, an alkyl group containing 5 or less carbon atoms (e.g., methyl, ethyl, n-propyl, n-butyl, n-amyl, isobutyl) or a substituted alkyl group containing 5 or less carbon atoms. Examples of substituents to be contained in such a substituted alkyl group include an alkoxy group containing 3 or less carbon atoms (e.g., methoxy, ethoxy), a sulfo group, a carboxyl group, a cyano group, a hydroxyl group, an amino group (e.g., dimethylamino, diethylamino), a carbamoyl group (e.g., hydroxyethylaminocarbonyl, ethylaminocarbonyl) and a sulfamoyl group (e.g., ethylaminosulfonyl).

Examples of the 5-membered or 6-membered ring formed by the connection of $R_5$ and $R_6$ or $R_6$ and $R_7$ include a piperidine ring, a morpholine ring, a pyrrolidine ring and a pyrrolidone ring.

The substituted methine represented by $L_1$, $L_2$ or $L_3$ includes as a substituent an alkyl group (e.g., methyl, ethyl, sulfoethyl), an aryl group (e.g., phenyl), a cyano group and a halogen atom (e.g., chlorine).

In formula (I), the ethanol portion of the sulfo group, carboxyl group and pyrazolone ring may be free or may form a salt such as sodium salt, potassium salt, $(C_2H_5)_3NH$ salt, pyridinium salt or ammonium salt.

In a preferred embodiment of the compound represented by formula (I), $R_3$ and $R_4$ each represents a hydrogen atom or a methyl group, $Q_1$ and $Q_2$ each represents a phenyl group or a substituted phenyl group (preferred examples of substituents include an alkyl group containing 4 or less carbon atoms, an alkoxy group containing 4 or less carbon atoms, a halogen atom (e.g., fluorine, chlorine, bromine), a dialkylamino group containing 6 or less carbon atoms, and a hydroxyl group), and $X_1$ and $X_2$ each represents a bond or —O— or —$NR_8$— in which $R_8$ is as defined above. Preferably, $m_1$ and $m_2$ each is 1. Particularly, $m_1$ and $m_2$ each is 1 and $R_1$ and $R_2$ each represents an alkyl group, an aryl group, a cyano group, —$COOR_5$, —$CONR_5R_6$, —$COR_7$, —$SO_2R_7$, —$SO_2NR_5R_6$ or —$NR_6SO_2R_7$ in which $R_5$, $R_6$ and $R_7$ are as defined above.

Specific examples of the dye represented by formula (I) will be shown hereinafter, but the present invention should not be construed as being limited thereto.

1

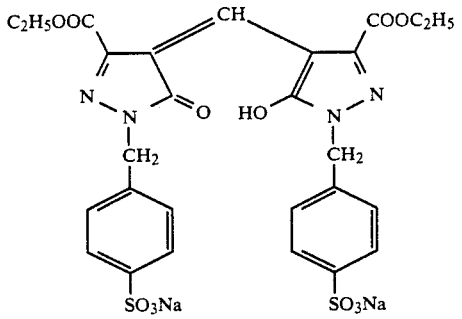

2

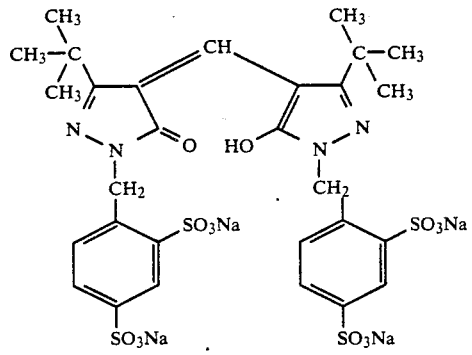

-continued
3
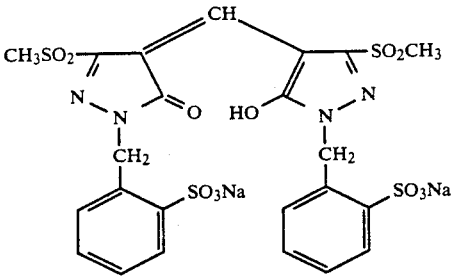
4
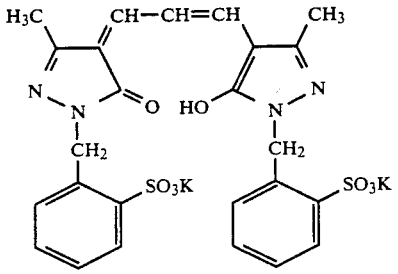
5
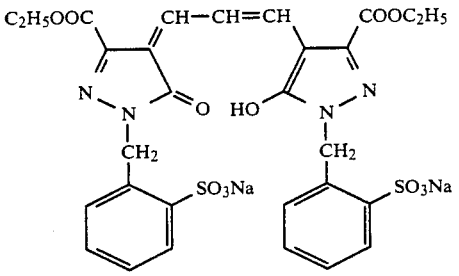
6
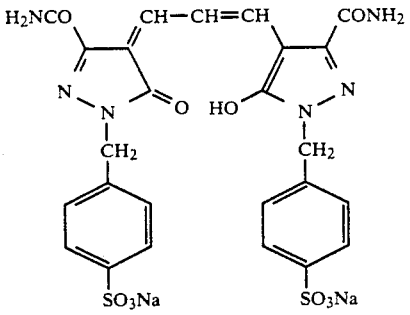
7
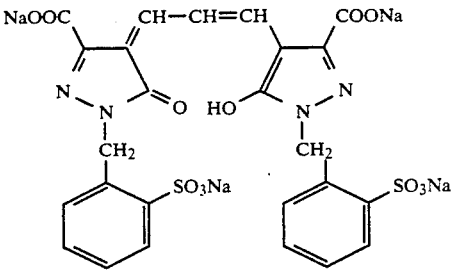

-continued
8
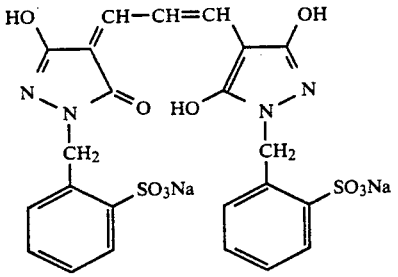
9
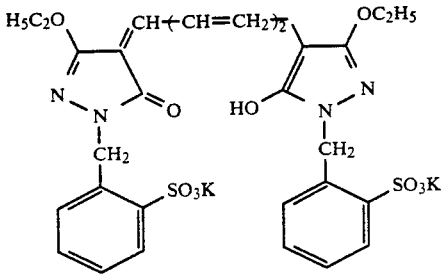
10
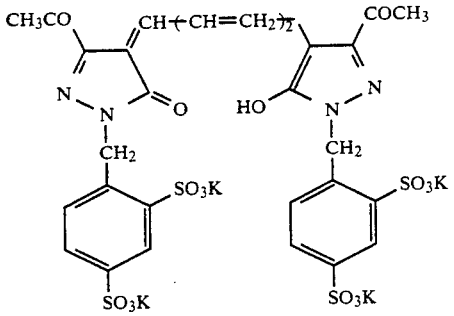
11
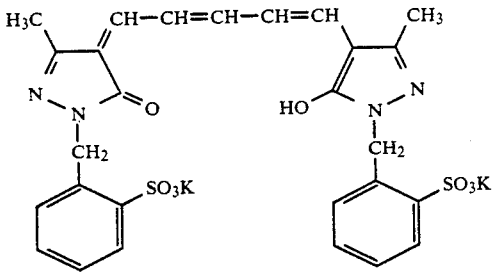
12
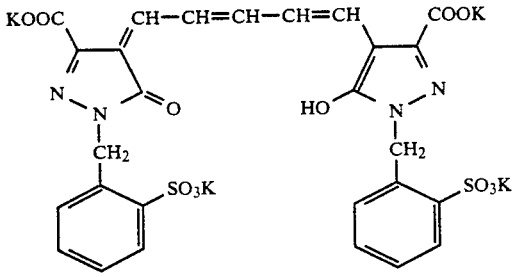

-continued
13
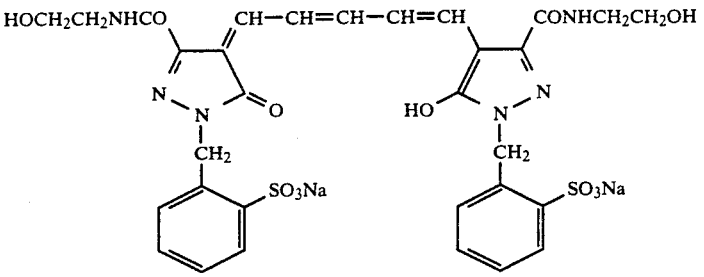
14
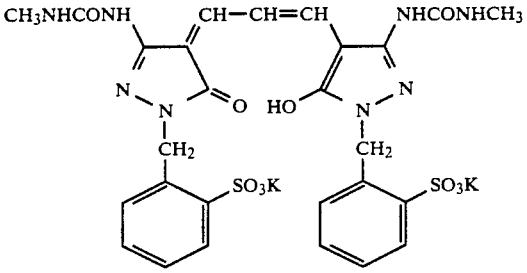
15
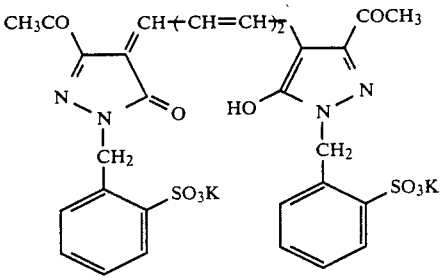
16
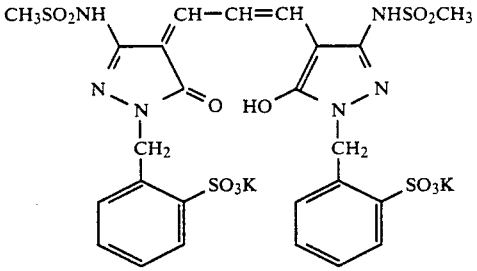
17
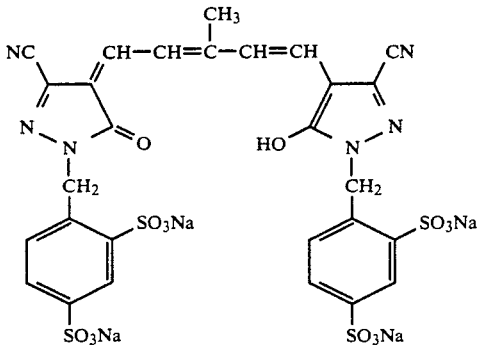

-continued
18
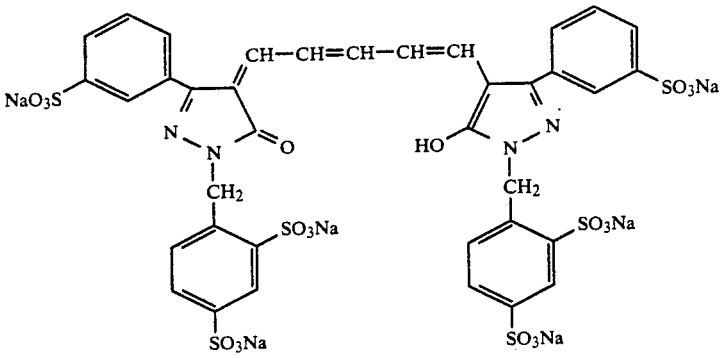
19
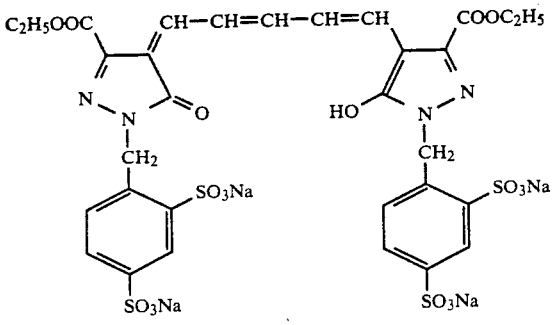
20
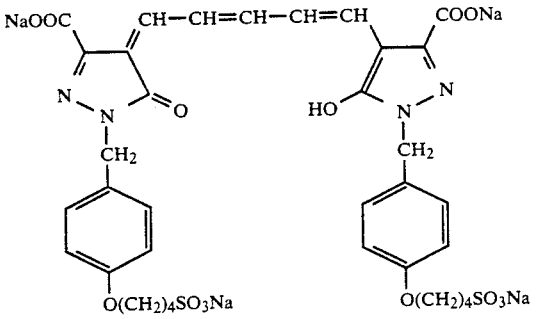
21
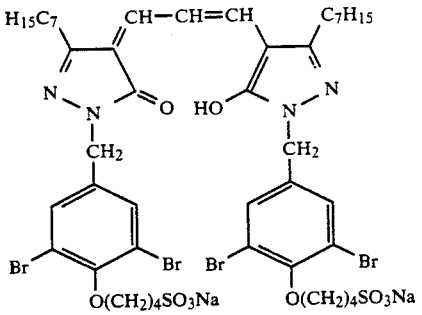
22
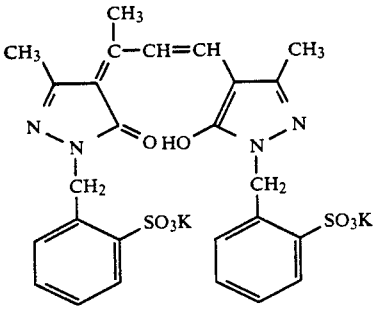

-continued
23
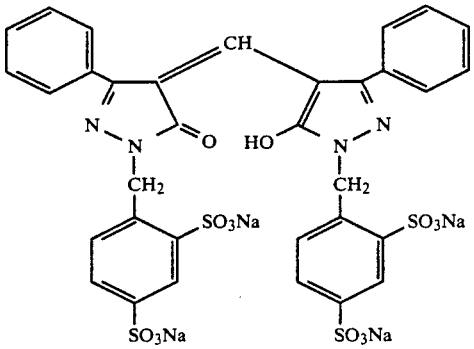
24
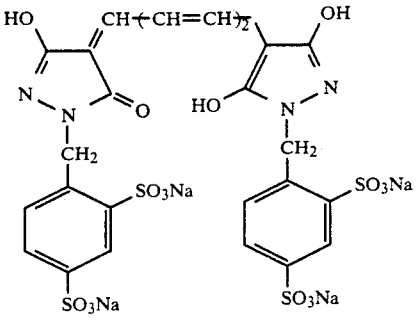
25
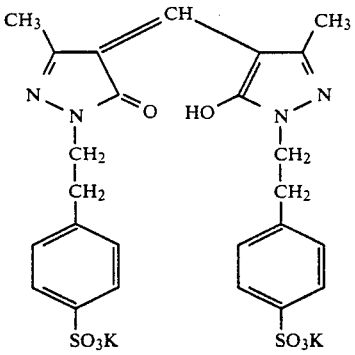
26
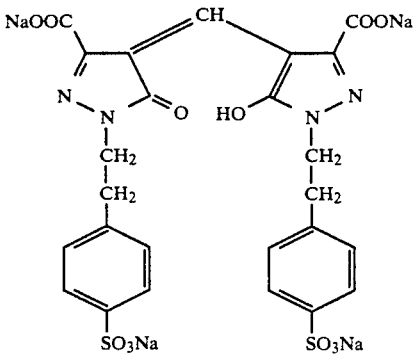

-continued
27
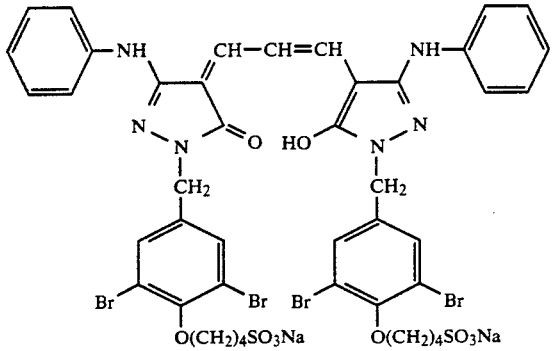
28
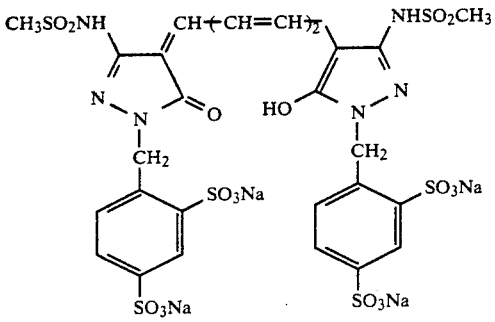
29
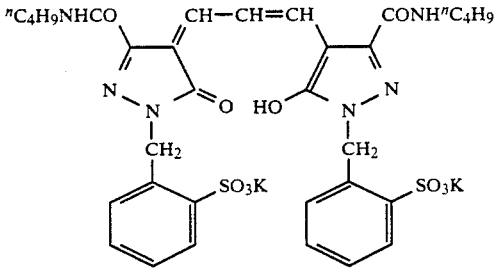
30
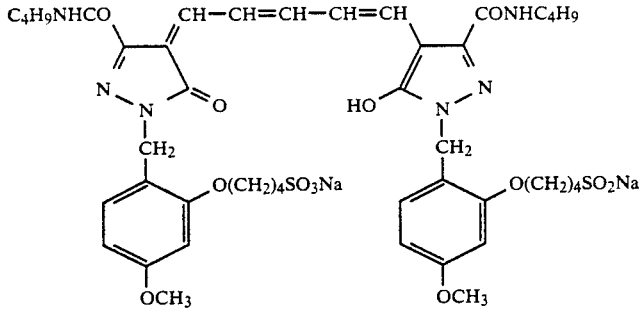
31
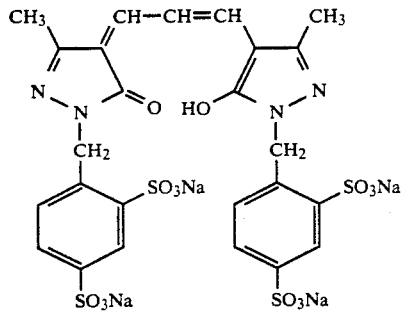

-continued
32
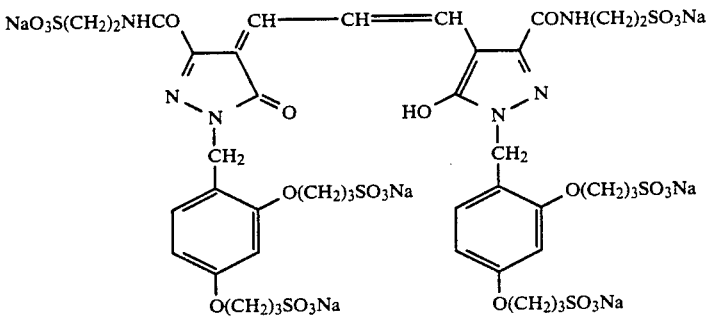
33
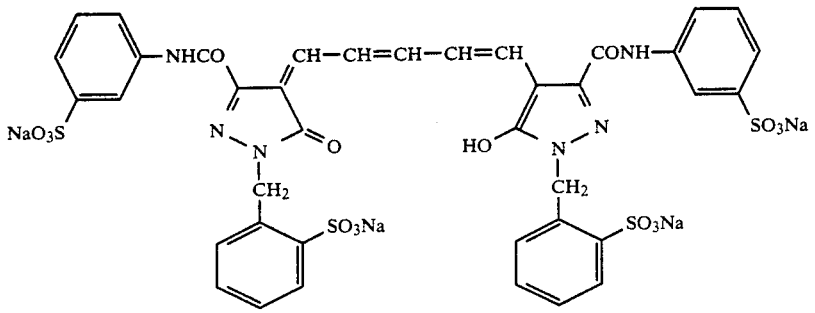
34
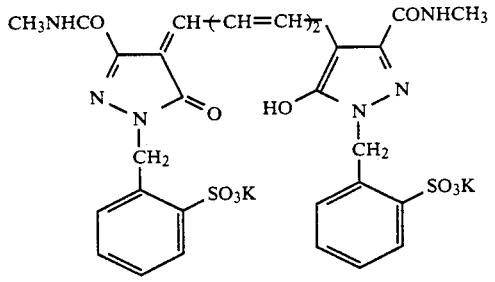
35
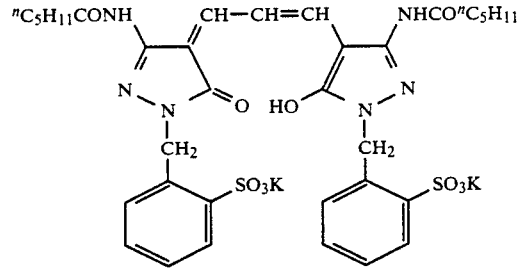
36
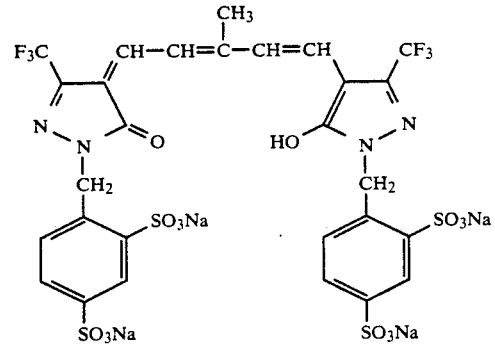

-continued
37
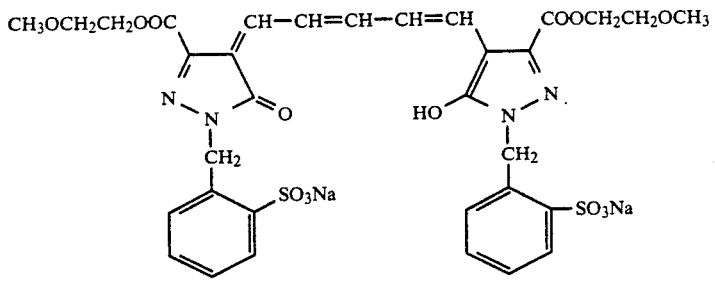
38
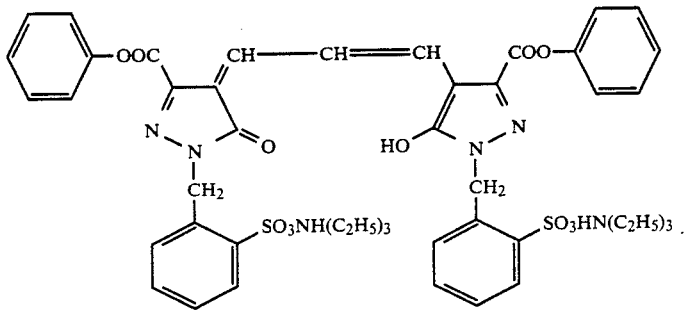
39
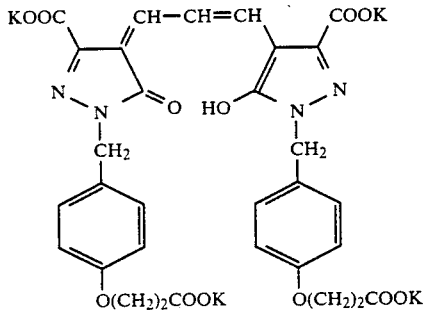
40
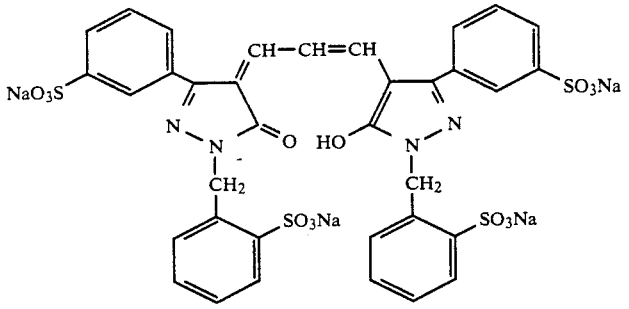
41
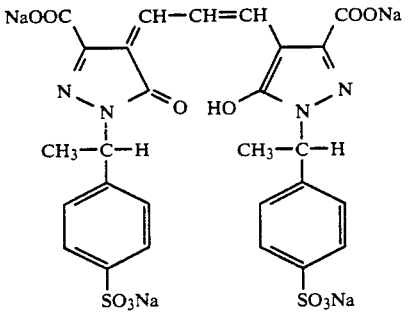

-continued
42
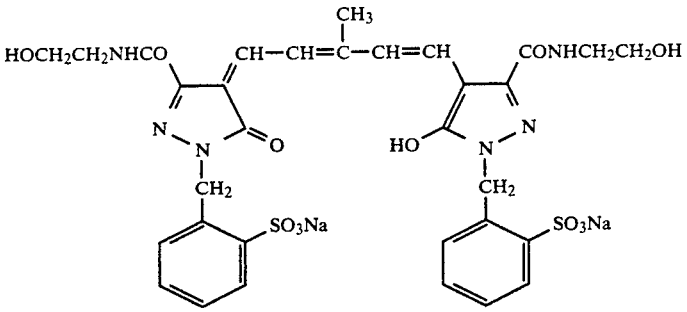
43
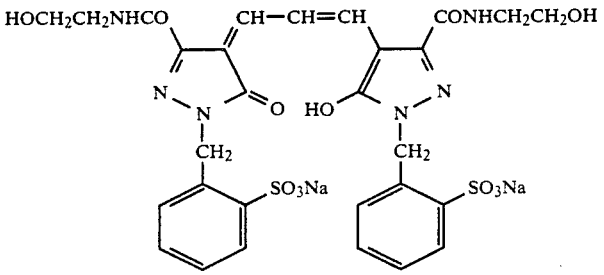
44
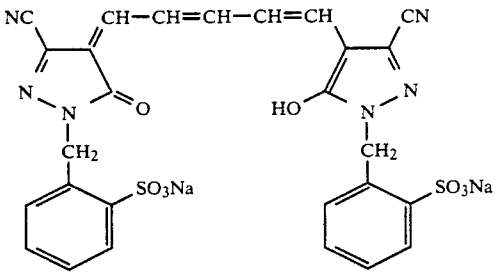
45
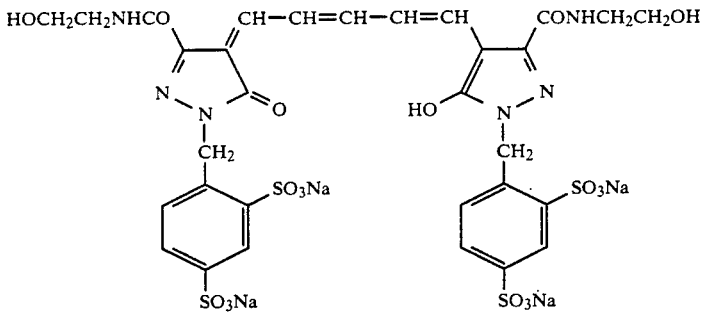
46
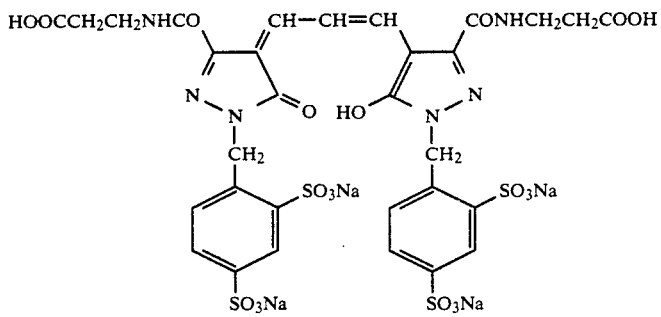

-continued
47
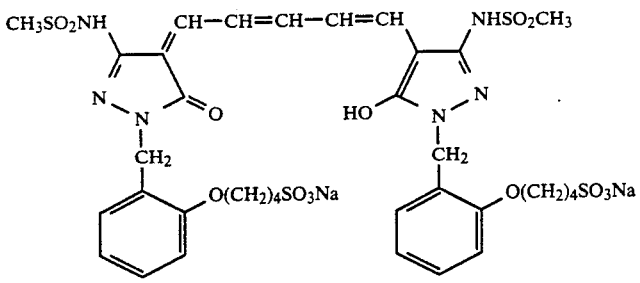
48
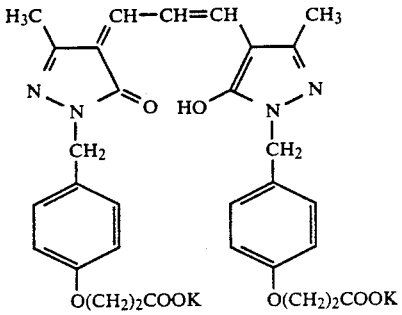
49
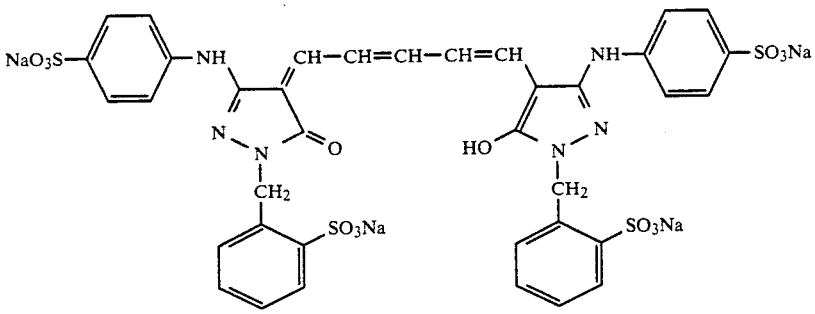
50
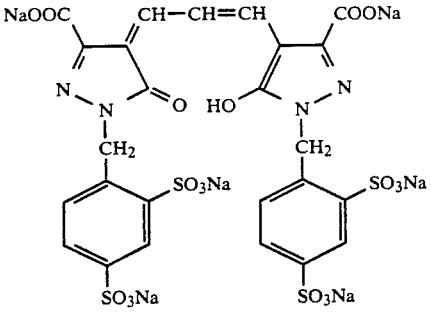
51
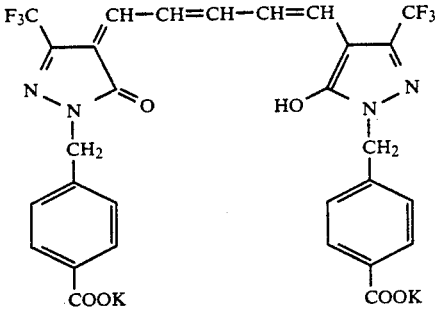

-continued
52
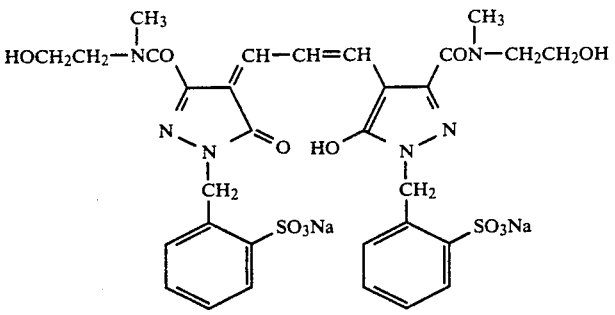
53
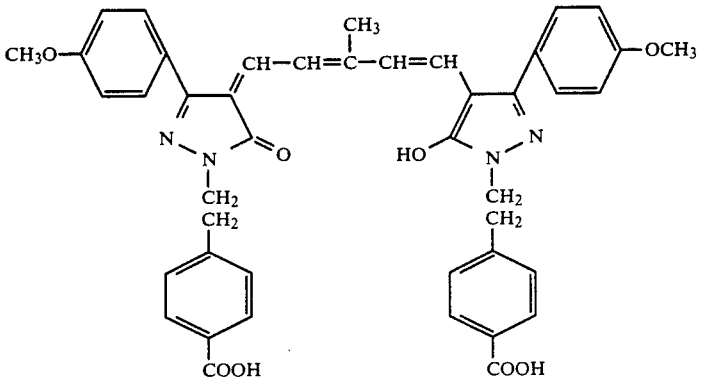
54
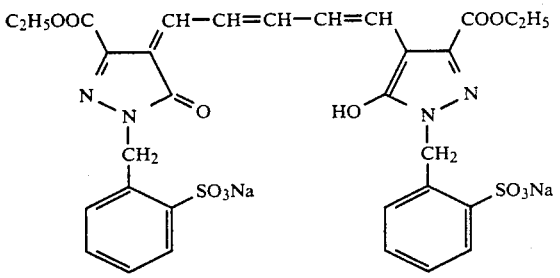
55
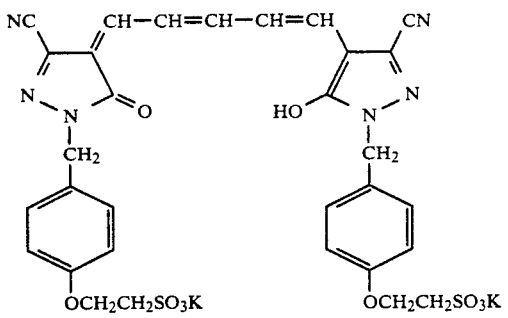
56
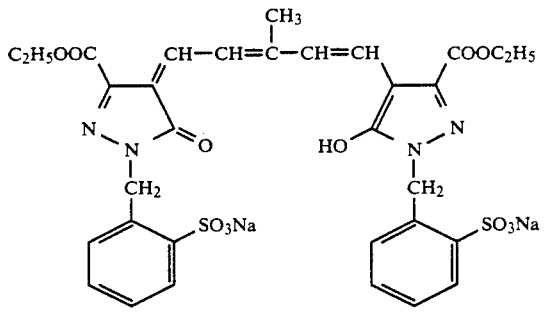

-continued

57

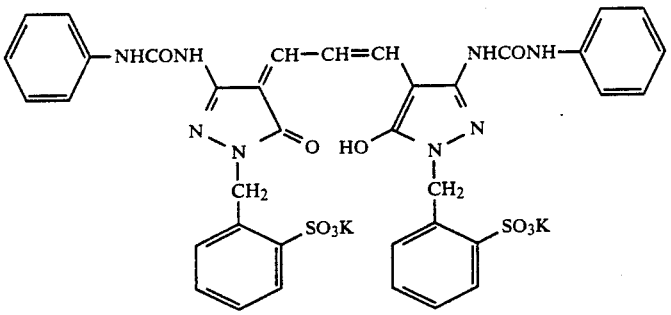

58

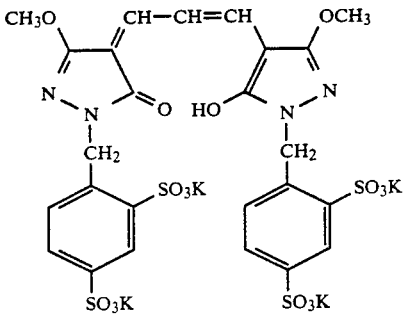

59

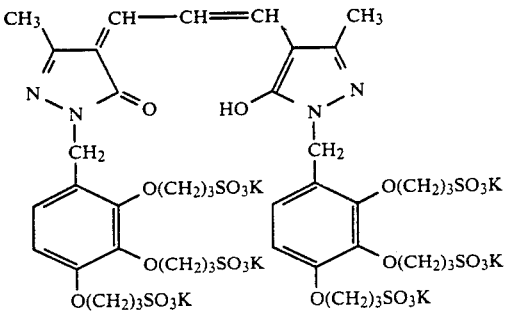

60

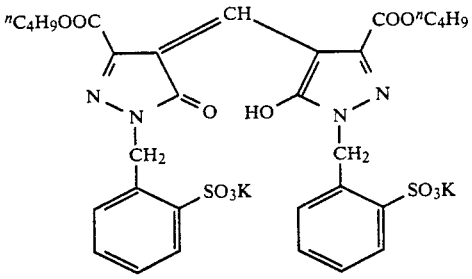

The synthesis of the dye of formula (I) can be accomplished by any suitable method as described in JP-A-50-145125, JP-A-50-147712, JP-A-59-111640 and JP-A-62-273527 (the term "JP-A" as used herein refers to a "published unexamined Japanese patent application"), and Japanese Patent Application Nos. 62-79483 and 62-110333 or any similar method.

The compounds of formula (I) can be synthesized by various methods, for example, by carrying out the condensation of a pyrazolone represented by formula (III) and a compound represented by formula (IVa), (IVb), (IVc), (IVd) or (IVe) in the presence of bases:

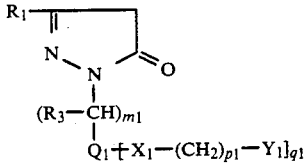

(III)

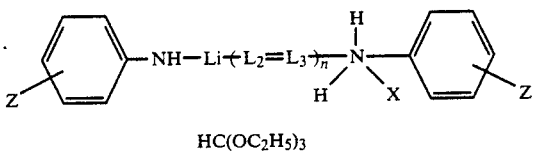

(IVa)

$HC(OC_2H_5)_3$ (IVb)

-continued

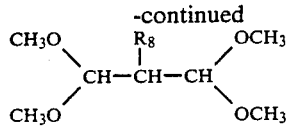

(IVc)

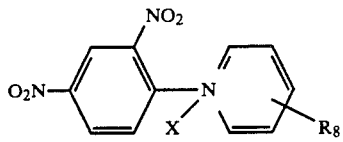

(IVd)

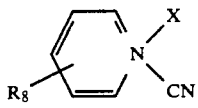

(IVe)

wherein $R_1$, $R_3$, $Q_1$, $X_1$, $Y_1$, $L_1$, $L_2$, $L_3$, $m_1$, n, $p_1$ and $q_1$ have the same definition as given above; Z represents hydrogen a nitro group, or a halogen atom (e.g., chlorine, bromine); $R_8$ represents hydrogen, an alkyl group (e.g., methyl, ethyl), or a phenyl group; and X represents an anion (e.g., chloride, bromide, iodide, perchlorate, methyl sulfate, ethyl sulfate, p-toluenesulfonate). The other compounds of those represented by formula (I) can be synthesized by a similar manner to the above-described method.

Examples of bases which are used in the condensation reaction include pyridine, piperidine, triethylamine, triethanolamine, sodium acetate, and potassium acetate.

Examples of solvents which are used for carrying out the condensation reaction include alcohols (e.g., methanol, ethanol, isopropanol), amides (e.g., dimethylformamide, dimethylacetamide, N-methylpyrrolidone), nitriles (e.g., acetonitrile), dimethyl sulfoxide, ethylene glycol, ethers (e.g., ethylene glycol monomethyl ether, ethylene glycol diethyl ether), water, and a mixture of water and the above-described solvents. The amount of the solvent in the mixture is preferably from 1 to 100 parts by volume per part by volume of water.

The reaction temperature may be selected from the range of from 0° C. to the boiling point of the solvent.

The reaction time is decided depending on the reaction temperature, and it is usually selected from the range of from about 30 minutes to about 3 days.

A pyrazolone represented by formula (III) is used in the condensation reaction in an amount of from 0.1 to 3 mols per mol of a compound represented by formula (IVa), (IVb), (IVc), (IVd) or (IVe).

The following is a description of the synthesis examples, for the compounds represented by formula (I).

SYNTHESIS EXAMPLE 1

Synthesis of Compound 5

To 50 ml of ethanol were added 5.2 g of 3-ethoxycarbonyl-1-(2-sulfobenzyl)pyrazoline-5-one, then 4.2 ml of triethylamine, and 1.5 g of malondialdehyde dianilate. The mixture was heated and refluxed for 3 hours to obtain a uniform solution. To this hot solution was added a solution prepared by dissolving 1.2 g of sodium acetate in 15 ml of methanol with stirring. Then, 25 ml of isopropanol was added to the above solution to deposit a dark purple crystal. This crystal was filtered out, washed with isopropanol, and dried to yield 2 g of Compound 5.

Melting Point: higher than 300° C. $\lambda^{H2O}$: 551 nm $\epsilon$:$6.73\times10^4$ ($\epsilon$: extinction exponent)

SYNTHESIS EXAMPLE 2

Synthesis of Compound 12

A mixture consisting of 7.4 g of 3-carboxy-1-(2-sulfobenzyl)pyrazoline-5-one, 50 ml of methanol, and 7.5 ml of triethylamine was prepared and cooled with ice. To this mixture was added 2.8 g of glutaraldehyde dianil hydrochloride with stirring for 3 hours. To this solution was added a solution prepared by dissolving 4.2 g of potassium acetate in 50 ml of methanol and further 25 ml of isopropanol to deposit a dark purple crystal. To crystal was filtered out, washed with isopropanol, and dried to yield 5.4 g of Compound 12.

Melting Point: higher than 300° C. $\lambda^{H2O}$: 626 nm $\epsilon$: $7.89\times10^4$ The compounds which are represented by formula (II) are nondiffusible cyan couplers.

SYNTHESIS EXAMPLE 3

Synthesis of Compound 13

A mixture consisting of 8 g of 3-(2-hydroxyethyl carbamoyl)-1-(2-sulfobenzyl)pyrazoline, 30 ml of methanol and 3.8 ml of triethylamine was prepared and cooled. To this solution were added 3 g of glutaraldehyde dianilate and then 2 ml of acetic anhydride. The mixture was reacted at room temperature for 1 hour, and then 20 ml of isopropanol was added to deposit a black crystal. The crystal was filtered out, washed with isopropanol, and dried to yield 6.1 g of Compound 13.

Melting Point: higher than 300° C. $\lambda^{H2O}$: 633 nm $\epsilon$: $8.8\times10^4$

SYNTHESIS EXAMPLE 4

Synthesis of Compound 26

A mixture consisting of 8 g of 3-carboxy-1-[2-(4-sulfophenyl)ethyl]pyrazoline-5-one, 50 ml of methanol, and 7 ml of triethylamine was prepared, and then 1.6 g of N,N'-diphenylformamidine hydrochloride was added and heated for 2 hours to produce a uniform solution. To this solution were added a solution prepared by dissolving 4.5 g of sodium acetate in 50 ml of methanol and further 20 ml of isopropanol to deposit a yellow crystal. This crystal was filtered out, washed with isopropanol and dried to yield 4 g of Compound 26.

Melting Point: higher than 300° C. $\lambda^{H2O}$: 452 nm $\epsilon$: $2.10\times10^4$

SYNTHESIS EXAMPLE 5

Synthesis of Compound 19

Compound 19 was obtained by using 3-ethoxycarbonyl-1-(2,4-disulfobenzyl)pyrazoline-5-one in the same manner as in Synthesis Example 2.

Melting Point: higher than 300° C. $\lambda^{H2O}$: 640 nm $\epsilon$: $7.02\times10^4$ The amount of the dye of formula (I) to be used is not specifically limited but is preferably in the range of 2 to 40 mg/m$^2$. If the value is 2 mg/m$^2$ or less, irradiation cannot be inhibited, causing a remarkable deterioration in sharpness. On the contrary, if the value is 40 mg/m$^2$ or more, the discolorability of the light-sensitive material is deteriorated particularly with rapid processing, possibly causing color stain.

The support to be used in the present invention is a reflective support comprising 3.0 g/m$^2$ or more of titanium oxide as white pigment. As such titanium oxide there may be used rutile titanium oxide or anatase titanium oxide. Alternatively, titanium oxide coated with metallic oxide such as hydrous aluminum oxide or hydrous ferrite oxide may be used in the present invention. As a reflective support for printing material there may be normally used paper laminated with an α-olefin polymer such as polyethylene. In the present invention, the α-olefin polymer layer may preferably comprise titanium oxide. When titanium oxide is incorporated in an amount of 3.0 g/m$^2$ or more, the effects of the present invention can be obtained. Titanium oxide may be preferably incorporated in an amount of 4.0 g/m$^2$ or more. As the titanium oxide content increases, the sharpness improves. However, when the titanium oxide content increases beyond 10.0 g/m$^2$, the sharpness shows little improvement, causing a cost increase. Therefore, the titanium oxide content preferably should not be more than 10.0 g/m$^2$. The particle diameter of the titanium oxide grains is not specifically limited but is preferably in the range of 0.05 to 10 mμ, particularly 0.1 to 0.5 mμ.

The emulsion layer in the present light-sensitive material may comprise a dye-forming coupler which undergoes a coupling reaction with an oxidation product of an aromatic primary amine developing agent in the color development process to form a dye.

In general, the blue-sensitive emulsion layer comprises a yellow coupler, the green-sensitive emulsion layer comprises a magenta coupler and the red-sensitive emulsion layer comprises a cyan coupler. However, different combinations may be used to prepare the present silver halide color photographic material depending on the application.

These dye-forming couplers may be either 2-equivalent or 4-equivalent couplers. These dye-forming couplers may contain a compound which undergoes a coupling reaction with an oxidation product of a developing agent to release a photographically useful fragment such as a development accelerator, bleach accelerator or fog inhibitor.

The cyan couplers, magenta couplers and yellow couplers which may be preferably used in the present invention can be represented by the following general formulae (IV), (V), (VI), (VII) and (VIII):

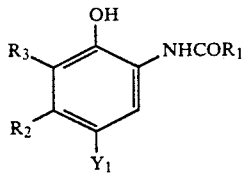

(IV)

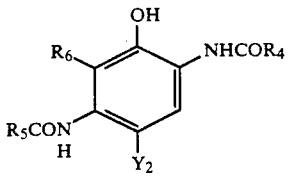

(V)

-continued

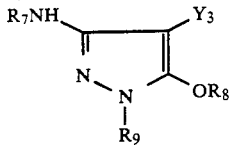

(VI)

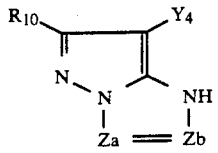

(VII)

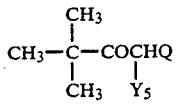

(VIII)

wherein $R'_1$, $R'_4$ and $R'_5$ each represents an aliphatic group, an aromatic group, a heterocyclic group, an aromatic amino group or a heterocyclic amino group; $R'_2$ represents an aliphatic group; $R'_3$ and $R'_6$ each represents an aliphatic atom, a halogen atom, an aliphatic group, an aliphatic oxy group or an acylamino group; $R'_7$ and $R'_9$ each represents a substituted or unsubstituted phenyl group; $R'_8$ represents a hydrogen atom, an aliphatic or aromatic acyl group or an aliphatic or aromatic sulfonyl group; $R'_{10}$ represents a hydrogen atom or a substituent; Q' represents a substituted or unsubstituted N-phenylcarbamoyl group; Za and Zb each represents a methine, a substituted methine or =N—; $Y'_1$, $Y'_2$ and $Y'_4$ each represents a halogen atom or a group capable of being eliminated upon a coupling reaction with an oxidation product of a developing agent (hereinafter referred to as an "elimination group"); $Y'_3$ represents a hydrogen atom or an elimination group; $Y=_5$ represents an elimination group; $R'_2$ and $R'_3$, and $R'_5$ and $R'_6$ each may together form a 5-, 6- or 7-membered ring in formulae (IV) and (V); and $R'_1$, $R'_2$, $R'_3$ or $Y'_1$; $R'_4$, $R'_5$, $R'_6$ or $Y'_2$; $R'_7$, $R'_8$, $R'_9$ or $Y'_3$; $R'_{10}$, Za, Zb or $Y'_4$; Q, or $Y'_5$ may form a dimer or higher polymer.

$R'_1$, $R'_2$, $R'_3$, $R'_4$, $R'_5$, $R'_6$, $R'_7$, $R'_8$, $R'_9$, $R'_{10}$, Za, Zb, $Y'_1$, $Y'_2$, $Y'_3$ and $Y'_4$ in formulae (IV), (V), (VI), (VII) and (VIII) are as defined for $R_1$, $R_2$, $R_3$, $R_4$, $R_5$, $R_6$, $R_7$, $R_8$, $R_9$, $R_{10}$, Za, Zb, $Y_1$, $Y_2$, $Y_3$ and $Y_4$, respectively, in formulae (I), (II), (III), (IV) and (V) described in Japanese Patent Application No. 61-175233 (pp. 3 to 34).

Specific examples of these color couplers include (C-1) to (C-40), (M-1) to (M-42), and (Y-1) to (Y-46) described in Japanese Patent Application No. 61-175233.

Preferred examples of these color couplers are set forth below.

c-(1)

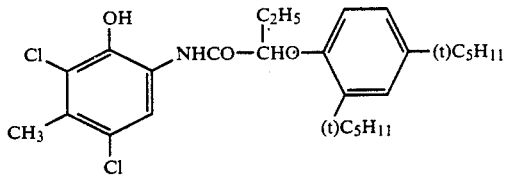

-continued
c-(2)
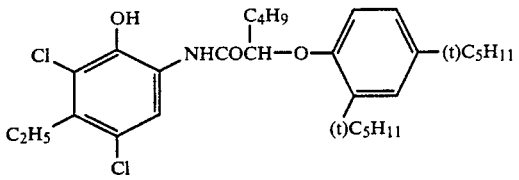
c-(3)
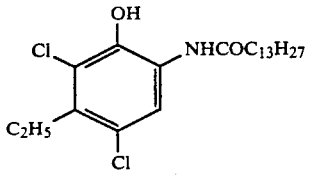
c-(4)
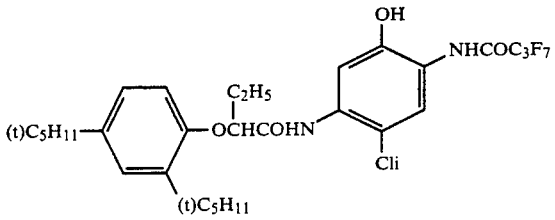
c-(5)
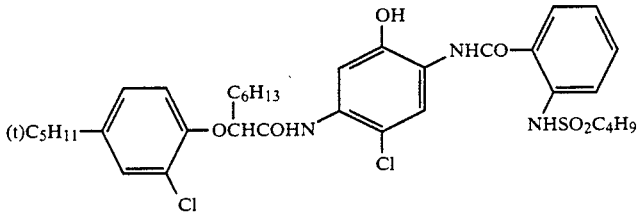
c-(6)
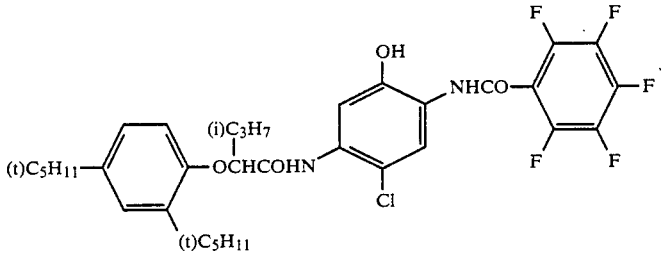
c-(7)
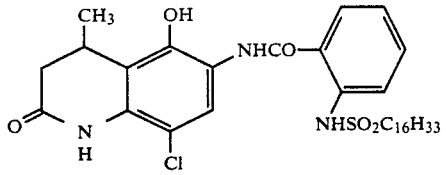
c-(8)
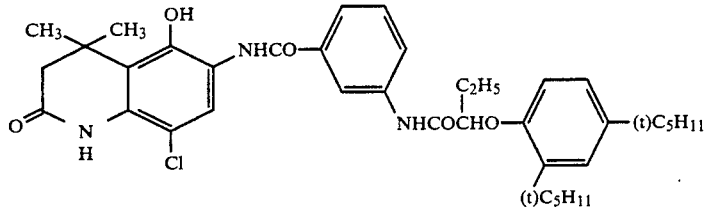
c-(9)
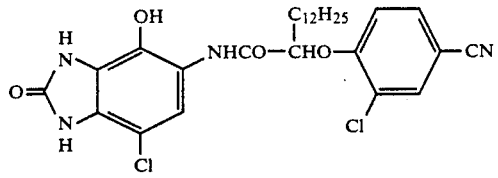

-continued
c-(10)
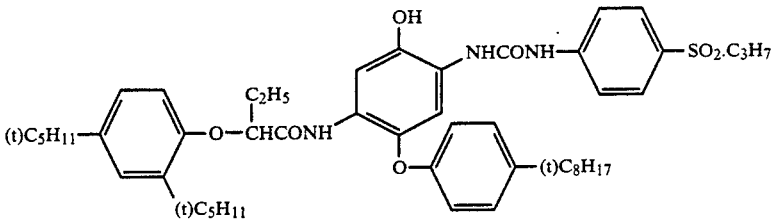
c-(11)
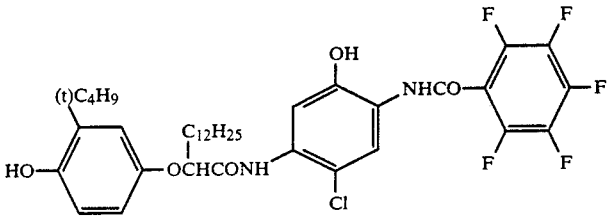
M-(1)
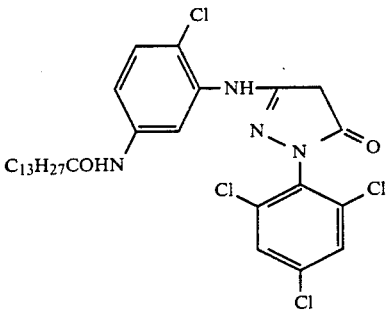
M-(2)
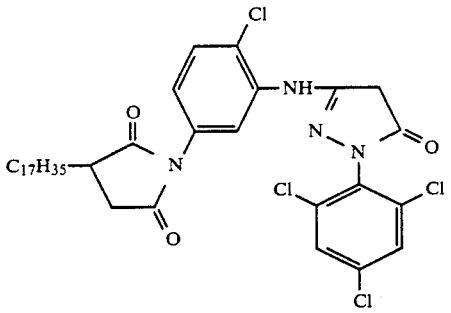
M-(3)
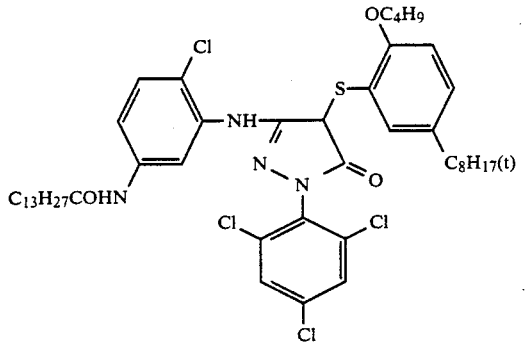

-continued
M-(4)
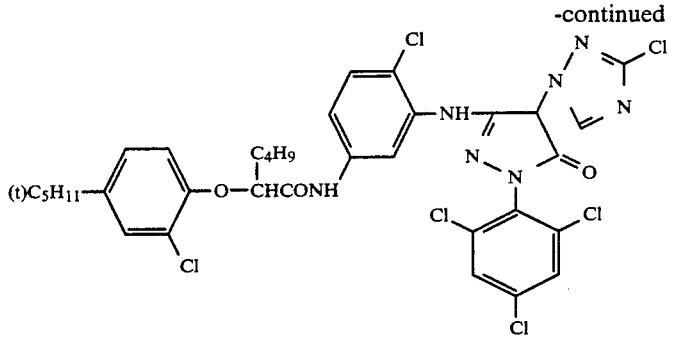
M-(5)
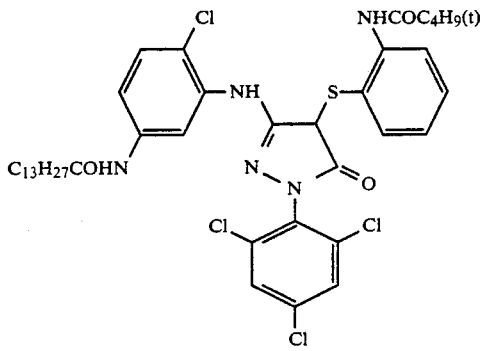
M-(6)
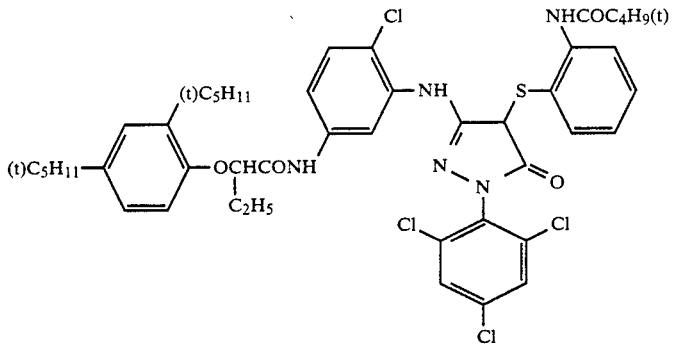
M-(7) to M-(14) represented by the following formula (M-I) in which $R_{33}$, $R_{34}$ and $X_2$ are shown below.
(M-I)
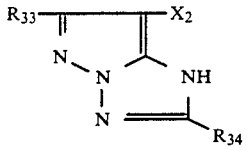
| Compound No. | $R_{33}$ | $R_{34}$ | $X_2$ |
|---|---|---|---|
| M-(7) | $CH_3$— | 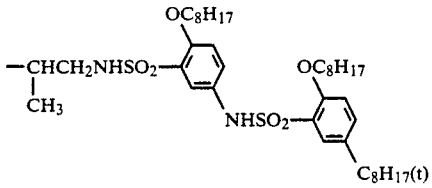 | Cl |
| M-(8) | " | 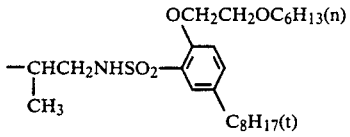 | " |

-continued
(M-I)
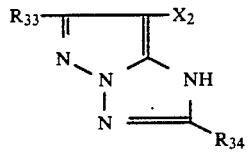
| Compound No. | $R_{33}$ | $R_{34}$ | $X_2$ |
|---|---|---|---|
| M-(9) | 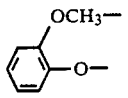 | 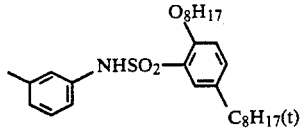 | 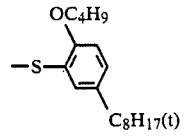 |
| M-(10) | $CH_3$— | 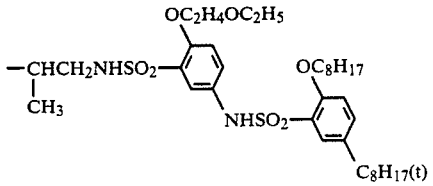 | Cl |
| M-(11) | 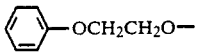 | 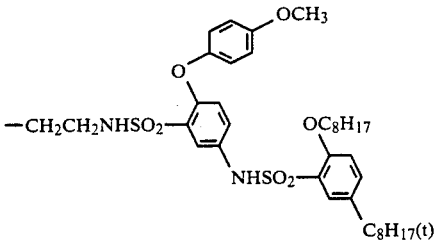 | 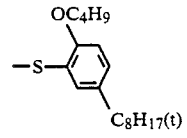 |
| M-(12) | $CH_2CH_2O$— | " | " |
| M-(13) | 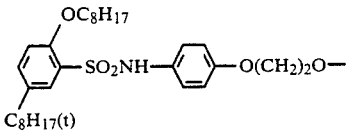 | 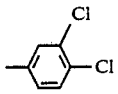 | " |
| M-(14) | 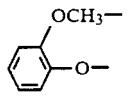 | 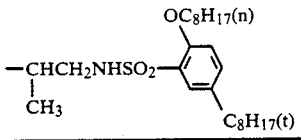 | Cl |
M-(15) to M-(22) represented by the following formula (M-II) in which $R_{33}$, $R_{34}$ and $X_2$ are shown below.
(M-II)
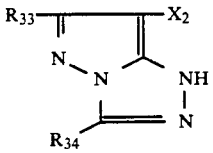
| Compound No. | $R_{33}$ | $R_{34}$ | $X_2$ |
|---|---|---|---|
| M-(15) | $CH_3$— | 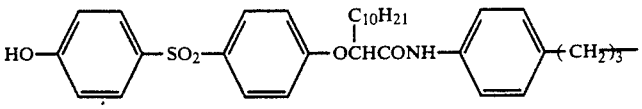 | Cl |

-continued
(M-II)
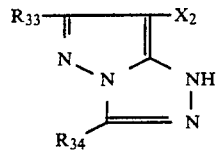
| Compound No. | $R_{33}$ | $R_{34}$ | $X_2$ |
|---|---|---|---|
| M-(16) | " | 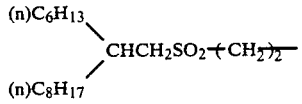 | " |
| M-(17) | 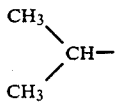 | 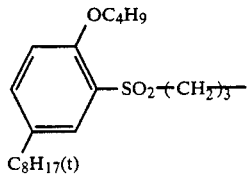 | " |
| M-(18) | 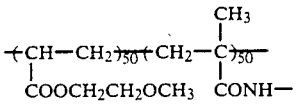 | 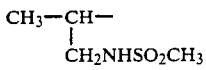 | " |
| M-(19) | 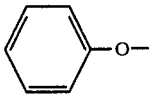 | 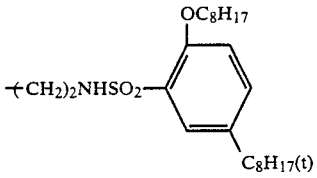 | Cl |
| M-(20) | $CH_3$— | 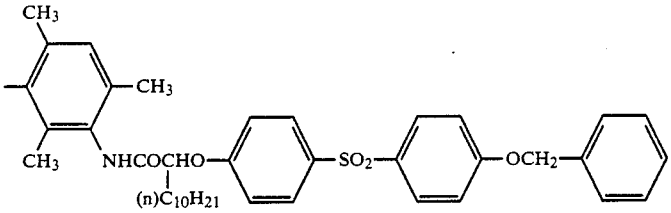 | " |
| M-(21) | $(CH_3)_3C$— | 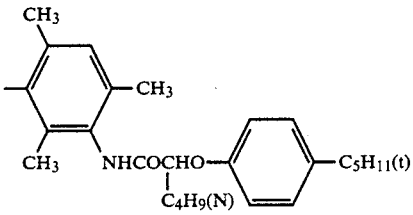 | " |
| M-(22) | 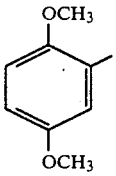 | 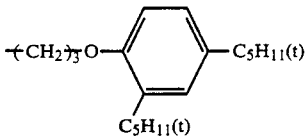 | " |

Y-(1)

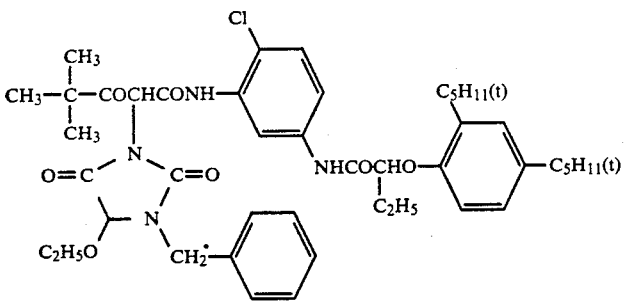

Y-(2)

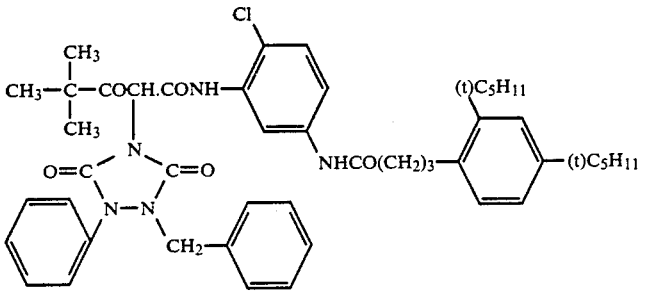

Y-(3)

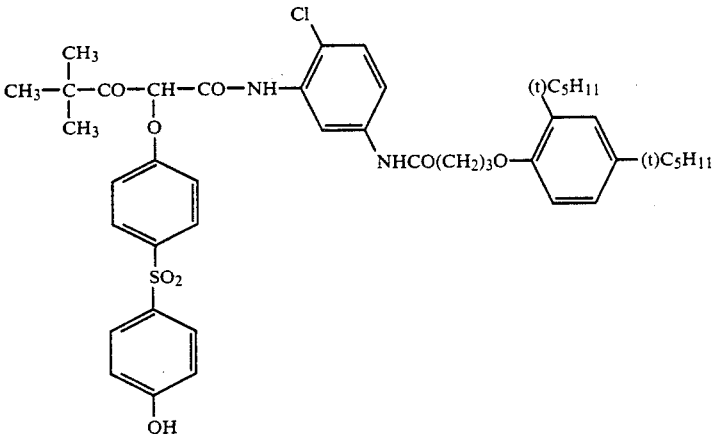

Y-(4)

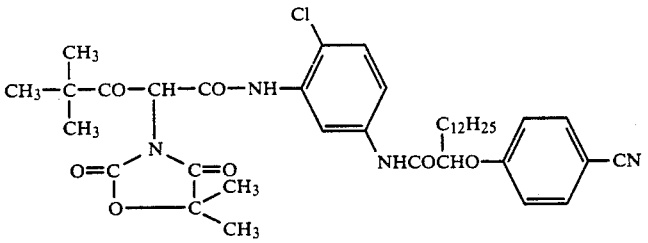

Y-(5)

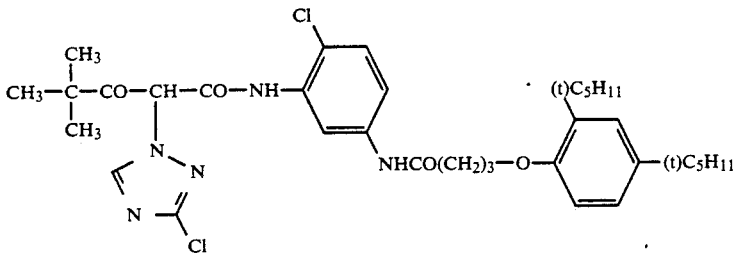

The standard amount of such a color coupler to be used is in the range of 0.001 to 1 mol per mol of light-sensitive silver halide. Particularly, the amount of a yellow coupler, magenta coupler and cyan coupler to be used are preferably in the range of 0.01 to 0.5 mol, 0.003 to 0.3 mol and 0.002 to 0.3 mol per mol of silver halide, respectively.

In a light-sensitive material comprising a color coupler of formula (IV), (V), (VI), (VII) or (VIII), the coated amount of silver halide is preferably in the range of 0.1 to 1.5 g/m$^2$.

These couplers may be incorporated in the emulsion layer in the form of a dispersion together with at least one high boiling point organic solvent. As such high boiling point organic solvents there may be preferably used high boiling point organic solvents represented by formulae (A) to (E):

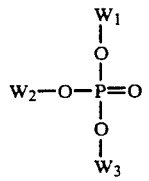
(A)

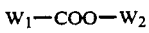
(B)

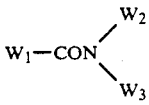
(C)

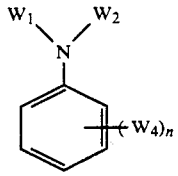
(D)

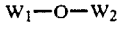
(E)

wherein $W_1$, $W_2$ and $W_3$ each represents a substituted or unsubstituted alkyl group, cycloalkyl group, alkenyl group, aryl group or heterocyclic group; $W_4$ represents $W_1$, O-$W_1$ or S-$W_1$; and n represents an integer 1 to 5, with the proviso that when n is 2 or more, the plurality of $W_4$'s may be the same or different and that $W_1$ and $W_2$ may together form a condensed ring in formula (E). More detailed explanation of the above-described high boiling point organic solvent is disclosed in JP-A-62-215272, pages 137 to 144.

The light-sensitive material according to the present invention may comprise a hydroquinone derivative, an aminophenol derivative, amines, a gallic acid derivative, a catechol derivative, an ascorbic acid derivative, a colorless coupler, a sulfonamidophenol derivative or the like as a color fog inhibitor or a color stain inhibitor.

The light-sensitive material to be used in the present invention may comprise a known discoloration inhibitor. Typical examples of such a known discoloration inhibitor include hydroquinone, 6-hydroxychroman, 5-hydroxycoumaran, spirochroman, p-alkoxyphenol, hindered phenols such as bisphenol, gallic acid derivatives, methylenedioxybenzene, aminophenol, hindered amines, and ether or ester derivatives obtained by silylating or alkylating phenolic hydroxyl groups thereof. Furthermore, metal complexes such as (bissalicylaldoximato)-nickel complex and (bis-N,N-dialkyldithiocarbamato)nickel complex may be used.

In order to prevent deterioration of yellow dye due to heat, moisture and light, a compound containing both hindered amine and hindered phenol partial structures in the same molecule as described in U.S. Pat. No. 4,268,593 can be advantageously used in the present invention. In order to prevent deterioration of magenta dye, particularly due to light, spiroindans as described in JP-A-56-159644 and hydroquinone diether or monoethersubstituted chromans as described in JP-A-55-89835 can be advantageously used in the present invention.

A dye stabilizer as described in JP-A-59-125732 is particularly useful for the stabilization of magenta images formed with a pyrazolotriazole magenta coupler.

In order to improve the preservability of cyan images, particularly its fastness to light, a benzotriazole ultraviolet absorber may be preferably used in combination. Such an ultraviolet absorber may be coemulsified with a cyan coupler.

The coated amount of such an ultraviolet absorber may be such that it at least suffices to render the cyan image fast to light. However, if such an ultraviolet absorber is used in too large an amount, it may yellow the unexposed portion (background) of the color photographic light-sensitive material. In general, the coated amount of such an ultraviolet absorber is preferably in the range of $1\times10^{-4}$ to $2\times10^{-3}$ mol/m$^2$, particularly $5\times10^{-4}$ to $1.5\times10^{-3}$ mol/m$^2$.

In the light-sensitive material layer structure of the ordinary color paper, an ultraviolet absorber may be incorporated in both or either, preferably both of the layers adjacent to the cyan coupler-containing red-sensitive emulsion layer. If such an ultraviolet absorber is incorporated in an intermediate layer between the green-sensitive layer and the red-sensitive layer, it may be coemulsified with a color stain inhibitor. If such an ultraviolet absorber is incorporated in the protective layer, another protective layer may be provided as the outermost layer. This protective layer may comprise a matting agent having any particle diameter or a mixture of latexes having different particle diameters.

In the present light-sensitive material, an ultraviolet absorber may be incorporated into a hydrophilic colloid layer.

As a suitable reflective support for the present invention there may be preferably used a material which exhibits an improved reflectivity to make clear dye images formed in the silver halide emulsion layer. Examples of such a reflective support material include a support material coated with a hydrophobic resin comprising titanium oxide and, optionally, a reflective substance such as zinc oxide, calcium carbonate or calcium sulfate dispersed therein and a vinyl chloride resin comprising a reflective substance dispersed therein. Specific examples of these support materials include baryta paper, polyethylene-coated paper, polypropylene synthetic paper, and transparent supports such as glass plates, polyester films (e.g., polyethylene terephthalate, cellulose triacetate, cellulose nitrate), polyamide films, polycarbonate films, and polystyrene films provided with a reflective layer or substance. These support materials may be properly selected depending on the application. Alternatively, a support material having a surface which exhibits mirror plane reflection or diffused reflection (2nd type) as described in JP-A-60-210346, and Japanese Patent Application Nos. 61-168800 and 61-168801 may be used.

The present invention can also be applied to a multilayer multicolor photographic material having at least two different spectral sensitivities on a support. A multilayer natural color photographic material normally comprises at least one red-sensitive emulsion layer, one green-sensitive emulsion layer and one blue-sensitive emulsion layer on a support. The order of arrangement of these emulsion layers can be properly selected. The above-described emulsion layers may each consist of two or more emulsion layers having different sensitivities. Alternatively, a light-insensitive layer may be interposed between two or more emulsion layers having the same color sensitivity.

Besides the silver halide emulsion layer, the light-sensitive material of the present invention may optionally comprise a protective layer, an intermediate layer, a filter layer, an antihalation layer, a backing layer or other auxiliary layers.

As a suitable binder or protective colloid for the emulsion layer or intermediate layer in the present light-sensitive material there may be advantageously used gelatin. Other hydrophilic colloids may be used.

Examples of such hydrophilic colloids which can be used in the present invention include protein such as gelatin derivatives, graft polymers of gelatin with other high molecular weight compounds, albumin, and casein, saccharide derivatives such as hydroxyethyl cellulose, carboxymethyl cellulose, cellulose ester sulfate, sodium alginate, and starch derivatives, monopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular weight compounds.

As gelatin there may be acid-treated gelatin or enzyme-treated gelatin as described in *Bull. Soc. Sci. Phot. Japan,* No. 16, page 30 (1966) besides lime-treated gelatin. Alternatively, hydrolyzates or enzymatic decomposition products of gelatin may be used.

Besides the above-described additives, the present light-sensitive material may comprise various stabilizers, stain inhibitors, developing agents or precursors thereof, development accelerators or precursors thereof, lubricants, mordants, matting agents, antistatic agents, plasticizers, or other various additives useful for photographic light-sensitive materials. Typical examples of these additives are described in *Research Disclosure,* Nos. 17643 (December, 1978) and 18716 (November, 1979).

The photographic emulsion layer or other hydrophilic colloid layer in the present light-sensitive material may comprise a stilbene, triazine, oxazole or coumarin brightening agent. Such a brightening agent may be water-soluble. Alternatively, a water-insoluble brightening agent may be used in the form of a dispersion.

The color developing solution which may be used to develop the present light-sensitive material is preferably an alkaline aqueous solution comprising an aromatic primary amine color developing agent as a main component. As such a color developing agent there can be an aminophenol compound. p-Phenylenediamine compounds may be more preferably used. Typical examples of such compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides or p-toluenesulfonates thereof. Two or more such compounds may be used in combination depending on the purpose of application.

The color developing solution normally comprises a pH buffer such as carbonates, borates or phosphates of alkaline metals or a development inhibitor or a fog inhibitor such as bromide, iodide, benzimidazole, benzothiazole or mercapto compounds. Alternatively, the color developing solution may optionally comprise various preservatives such as hydroxylamine, diethylhydroxylamine, sulfite, hydrazine, phenylsemicarbazide, triethanol, catecholsulfonic acid, and triethylenediamine(1,4-diazabicyclo[2,2,2]octane), organic solvents such as ethylene glycol, and diethylene glycol, development accelerators such as benzyl alcohol, polyethylene glycol, quaternary ammonium salt, and amine, dye-forming couplers, competitive couplers, fogging agents such as sodium boron hydride, auxiliary developing agents such as 1-phenyl-3-pyrazolidone, thickening agents, and various chelating agents such as aminopolycarboxylic acid, aminopolyphosphonic acid, alkylphosphonic acid, and phosphonocarboxylic acid. Typical examples of such chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid), and salts thereof.

The supply amount of such a color developing solution and a black-and-white developing solution depends on the color photographic light-sensitive material to be processed but is normally in the range of 3 liters or less per 1 $m^2$ of the light-sensitive material. The supply amount of the developing solution can be reduced to 500 ml or less by decreasing the concentration of bromide ions in the supply solution. If the supply amount of the developing solution is reduced, the evaporation or air oxidation of the solution is preferably prevented by reducing the area of the processing bath in contact with air. Alternatively, a means of inhibiting the accumulation of bromide ions in the developing solution may be used to reduce the supply amount of the developing solution.

Once subjected to color development, the photographic emulsion layer is normally subjected to bleach. The bleach may be effected simultaneously with or separately from fixation (blix). In order to speed up the processing, the bleach may be followed by the blix. Alternatively, the processing may be effected in two continuous blix baths. Furthermore, the fixation may be effected before the blix. Moreover, the blix may be followed by the bleach. These alternate processes may be optionally selected depending on the purpose of application. As a suitable bleaching agent there may be used a compound of a polyvalent metal such as iron(III), cobalt(III), chromium(VI), or copper(II), a peroxide, a quinone, a nitro compound, or the like. Typical examples of bleaching agents which can be used in the present invention include ferricyanides, bichromates, organic complexes of iron(III) or cobalt(III) with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid, citric acid, tartaric acid, or malic acid, persulfates, bromates, permanganates, and nitrobenzenes. Among these compounds, complexes of iron(III) with aminopolycarboxylic acids, including ferric ethyenediaminetetraacetate, and persulfates are preferably used in light of rapidness of processing and prevention of environmental pollution. Complexes of iron(III) with aminopolycarboxylic acids are also useful for the bleaching solution or the blix solution.

The bleaching solution, blix solution and their prebaths may optionally comprise a bleach accelerator. Specific examples of suitable bleach accelerators which can be used in the present invention include compounds containing mercapto or disulfide groups as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, and *Research Disclosure,* No. 17129 (July, 1978), thiazolidine derivatives as described in JP-A-50-140129, thiourea derivatives as described in JP-B-45-8506 (the term "JP-B" as used herein refers to an "examined Japanese patent publication"), JP-A-52-20832 and JP-A-53-32735, and U.S. Pat. No. 3,706,561, iodides as described in JP-A-58-16235, and West German Patent 1,127,715, polyoxyethylene compounds as described in West German Patents 966,410 and 2,748,430, polyamine compounds as described in JP-B-45-8836, compounds as described in JP-A-49-42434, JP-A-49-59644, JP-A-53-94927, JP-A-54-35727, JP-A-55-26506, and JP-A-58-163940, and bromide ions. Among these compounds, compounds containing mercapto groups or disulfide groups are preferably used in light of the accelerating effect. Particularly preferred among these compounds are compounds as described in U.S. Pat. No. 3,893,858, West German Patent 1,290,812, and JP-A-53-95630 . Furthermore, compounds as described in U.S. Pat. No. 4,552,834 can be preferably used. These bleach accelerators may be incorporated in the light-sensitive material.

Examples of suitable fixing agents which can be used in the present invention include thiosulfates, thiocyanates, thioether compounds, thioureas, and iodides (in a large amount). Among these compounds, thiosulfates are commonly used. Particularly, ammonium thiosulfate can be most widely used. As a suitable preservative for the blix solution there can be preferably used sulfite, bisulfite, or carbonyl-bisulfurous acid addition products.

After being subjected to desilvering, the present silver halide color photographic material is normally subjected to rinse and/or stabilization. The amount of water to be used in the rinse step can be widely determined depending on the properties of the light-sensitive material (e.g., coupler), the application of the light-sensitive material, the temperature of the rinsing water, the number of rinsing tanks (number of stages), the supply system (i.e., countercurrent or forward current), and other various conditions. The relationship between the number of rinsing tanks and the amount of water to be used in a multistage countercurrent supply system can be determined by a method described in *Journal of the Society of Motion Picture and Television Engineers,* Vol. 64, pp. 248–253 (May, 1955).

In the multistage countercurrent process as described in the above cited reference, the amount of rinsing water to be used can be drastically reduced. However, the multistage countercurrent process is disadvantageous in that the time of water retention in the tanks is increased, causing proliferation of bacteria which produces suspended materials that will be attached to the light-sensitive material. In the present process for the processing of a light-sensitive material, the approach as described in JP-A-62-288838 which comprises reducing the calcium and magnesium ion concentration can be effectively used to overcome such a problem. Such a problem can also be solved by the use of a proper sterilizer such as isothiazolone compounds and thiabenzazoles as described in JP-A-57-8542, chlorine sterilizers (e.g., sodium chlorinated isocyanurate), and sterilizers as described in Hiroshi Horiguchi, *Chemistry of Antibacterial and Antifungal Agents,* Eisei Gijutsukai, *Technique for Sterilization and Fungi-Proofing of Microorganism,* and Nihon Bokin Bobai Gakkai, *Dictionary of Antibacterial and Antifungal Agents.*

The rinsing water to be used in the present processing has a pH value of 4 to 9, preferably 5 to 8. The rinsing temperature and rinsing time can be widely determined depending on the characteristics and application of the light-sensitive material to be processed but are normally in the range of 15° to 45° C. and 20 seconds to 10 minutes, preferably 25° to 40° C. and 30 seconds to 5 minutes, respectively. Furthermore, in the present process for the formation of color images, the abovedescribed rinse may be replaced by the stabilizing step. Such a stabilizing step can be accomplished by any known method as described in JP-A-57-8543, JP-A-58-14834 and JP-A-60-220345. Such a stabilizing bath, too, may comprise various chelating agents or antifungal agents.

Alternatively, the above-described rinsing process may be optionally followed by the stabilization process The overflow liquid produced with the supply of the above-described rinsing solution and/or stabilizing solution can be reused in the other steps such as the desilvering step.

The present silver halide color light-sensitive material may comprise a color developing agent for the purpose of simplifying and expediting the processing. To this end, such a color developing agent can be incorporated in the light-sensitive material in the form of various precursors thereof. Examples of such precursors of color developing agents include indoaniline compounds as described in U.S. Pat. No. 3,342,597, Schiff base compounds as described in U.S. Pat. No. 3,342,599, and *Research Disclosure,* Nos. 14850 and 15159, aldol compounds as described in *Research Disclosure,* No. 13924, metal complexes as described in U.S. Pat. No. 3,819,492, and urethane compounds as described in JP-A-53-135628.

The present silver halide color light-sensitive material may optionally comprise various 1-phenyl-3-pyrazolidones for the purpose of accelerating color development. Typical examples of such compounds are described in JP-A-56-64339, JP-A-57-144547, and JP-A-58-115438.

The various processing solutions to be used in the present invention are used at a temperature of 10° to 50° C. The standard temperature range is normally between 33° C. and 38° C. However, a higher temperature can be used to accelerate and shorten the processing. On the contrary, a lower temperature can be used to improve the picture quality or the stability of the processing solution. For the purpose of saving the amount of silver to be incorporated in the light-sensitive material, a processing using cobalt intensification or hydrogen peroxide intensification as described in West German Patent 2,226,770, and U.S. Pat. No. 3,674,499 may be effected.

Each processing bath can be optionally provided with a heater, temperature sensor, liquid level sensor, circulating pump, filter, various floating cover, various squeegees, or the like.

The present invention will be further described in the following examples, but the present invention should not be construed as being limited thereto.

Unless otherwise indicated, all parts, percents and ratios are by weight.

EXAMPLE 1

A silver halide emulsion (1) to be incorporated into a blue-sensitive silver halide emulsion layer was prepared in the following manner:

| | |
|---|---|
| Solution 1 | |
| $H_2O$ | 1,000 cc |
| NaCl | 5.8 g |
| Gelatin | 25 g |
| Solution 2 | |
| 1 N Sulfuric Acid | 20 cc |
| Solution 3 | |
| A compound of the following formula (1% aq. soln.) | 3 cc |

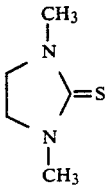

| | |
|---|---|
| Solution 4 | |
| KBr | 0.18 g |
| NaCl | 130 cc |
| $H_2O$ to make | 130 cc |
| Solution 5 | |
| $AgNO_3$ | 25 g |
| $H_2O$ to make | 130 cc |
| Solution 6 | |
| KBr | 0.70 g |
| NaCl | 34.05 g |
| $K_2IrCl_6$ (0.001% aq. soln.) | 2 cc |
| $H_2O$ to make | 285 cc |
| Solution 7 | |
| $AgNO_3$ | 100 g |
| $H_2O$ to make | 285 cc |

Solution 1 was heated to a temperature of 60° C., and then added to Solution 2 and Solution 3. Solution 4 and Solution 5 were then simultaneously added to the admixture in 60 minutes. After 10 minutes, Solution 6 and Solution 7 were then simultaneously added to the admixture in 25 minutes. After 5 minutes, the admixture was cooled and desalted. Water and dispersed gelatin were then added to the system so that the pH value thereof was adjusted to 6.0. As a result, a monodispersed emulsion of cubic silver chlorobromide grains with an average particle size of 1.0 μm, a particle size fluctuation coefficient of 0.11 (s/d; value obtained by dividing standard deviation by average particle size) and a silver bromide content of 1 mol % was obtained. The emulsion thus obtained was then subjected to optimum chemical sensitization with triethyl thiourea. A spectral sensitizing dye of the undermentioned formula (Sen-1) was further added to the emulsion in an amount of $7\times10^{-4}$ mol per mol of silver halide emulsion.

A silver halide emulsion (2) to be incorporated into a green-sensitive silver halide emulsion layer and a silver halide emulsion (3) to be incorporated into a red-sensitive silver halide emulsion layer were prepared in the same manner as described above except that the amounts of chemicals to be added and the temperature at and the time in which these chemicals were added were changed.

Particularly, when the silver halide emulsion (2) was prepared, a spectral sensitizing dye (Sen-2) was used in an amount of $5\times10^{-4}$ mol per mol of emulsion. When the silver halide emulsion (3) was prepared, a spectral sensitizing dye (Sen-3) was used in an amount of $0.9\times10^{-4}$ mol per mol of emulsion.

The crystal structure, average particle size, halogen composition and particle size fluctuation coefficient of the silver halide emulsions (1) to (3) were as follows:

| Emulsion | Crystal Structure | Average Particle Size (μm) | Halogen Composition (Br mol %) | Fluctuation Coefficient |
|---|---|---|---|---|
| (1) | Cube | 1.00 | 1.0 | 0.11 |
| (2) | " | 0.45 | 1.0 | 0.09 |
| (3) | " | 0.34 | 1.8 | 0.10 |

(Sen-1)

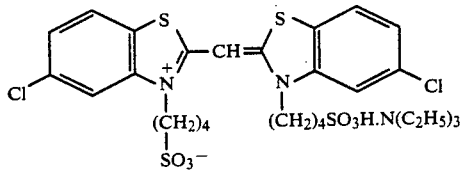

(Sen-2)

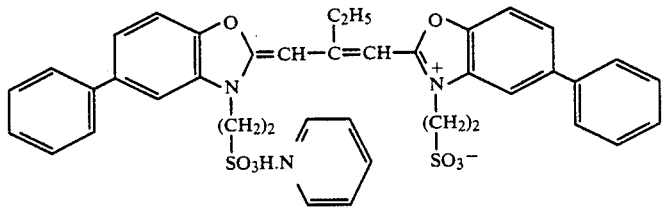

-continued (Sen-3)

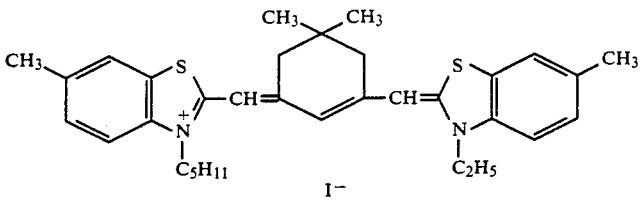

The silver halide emulsions (1) to (3) thus obtained were used to prepare a multilayer color photographic light-sensitive material having the undermentioned layer structure. The coating solutions for the various layers were prepared in the following manner:

Coating Solution for the 1st Layer 19.1 g of a yellow coupler (ExY) was dissolved in 27.2 cc of ethyl acetate and 3.8 cc of a solvent (Solv-1). The solution thus obtained was then emulsiondispersed in 185 cc of a 10% aqueous solution of gelatin containing 8 cc of 10% sodium dodecylbenzenesulfonate. On the other hand, the blue-sensitive sensitizing dye (Sen-1) was added to the silver halide emulsion (1) in an amount of $5.0\times10^{-4}$ mol per mol of silver. The emulsion dispersion and the emulsion thus obtained were mixed in such a manner that a coating solution for the 1st layer having the undermentioned composition was prepared.

The coating solutions for the 2nd layer to the 7th layer were prepared in the same manner as described above.

As a gelatin hardener for each layer there was used sodium 1-oxy-3,5-dichloro-s-triazine.

For the red-sensitive emulsion layer, the following compound was incorporated in an amount of $1.9\times10^{-3}$ mol per mol of silver halide.

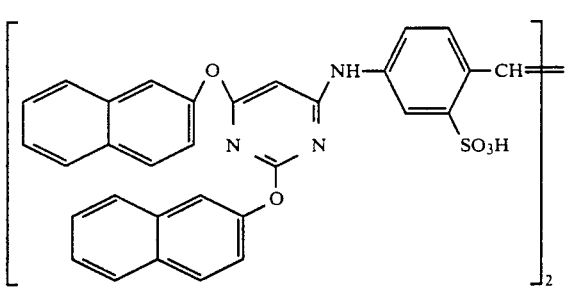

For the blue-sensitive emulsion layer, 4-hydroxy-6-methyl-1,3,3a,7-tetraazaindene was incorporated in an amount of $1.0\times10^{-2}$ mol per mol of silver halide.

For the blue-sensitive emulsion layer and the green-sensitive emulsion layer, 1-(5-methylureidophenyl)-5-mercaptotetrazole was incorporated in amounts of $1.0\times10^{-3}$ mol and $1.5\times10^{-3}$ mol per mol of silver halide, respectively.

For the red-sensitive emulsion layer, 2-amino-5-mercapto-1,3,4-thiadiazole was incorporated in an amount of $2.5\times10^{-4}$ mol per mol of silver halide.

The composition of the various layers will be described hereinafter. The composition of each layer is shown hereinafter. Numerical figures indicate the amounts of coatings ($g/m^2$), and the amounts of silver halide emulsions are calculated in terms of silver.

Support

Paper support laminated with polyethylene on both sides thereof (polyethylene on the 1st layer side contained $TiO_2$ as white pigment (2.7 $g/m^2$) and ultramarine (blue dye))

| | |
|---|---|
| 1st Layer: Blue-Sensitive Layer | |
| Silver Halide Emulsion (1) | 0.26 |
| Gelatin | 1.13 |
| Yellow Coupler (ExY) | 0.66 |
| Solvent (Solv-1) | 0.26 |
| 2nd Layer: Color Stain Inhibiting Layer | |
| Gelatin | 0.89 |
| Color Mixing Preventing Agent (Cpd-1) | 0.08 |
| Solvent (Solv-1) | 0.20 |
| Solvent (Solv-2) | 0.20 |
| Dye (T-1) | 0.02 |
| 3rd Layer: Green-Sensitive Layer | |
| Silver Halide Emulsion (2) | 0.29 |
| Gelatin | 0.99 |
| Magenta Coupler (ExM-1) | 0.25 |
| Dye Image Stabilizer (Cpd-2) | 0.10 |
| Dye Image Stabilizer (Cpd-3) | 0.05 |
| Dye Image Stabilizer (Cpd-4) | 0.07 |
| Dye Image Stabilizer (Cpd-5) | 0.01 |
| Solvent (Solv-2) | 0.19 |
| Solvent (Solv-3) | 0.15 |
| 4th Layer: Ultraviolet Absorbing Layer | |
| Gelatin | 1.42 |
| Ultraviolet Absorber (UV-1) | 0.52 |
| Color Mixing Preventing Agent (Cpd-1) | 0.06 |
| Solvent (Solv-4) | 0.26 |
| 5th Layer: Red-Sensitive Layer | |
| Silver Halide Emulsion (3) | 0.22 |
| Gelatin | 1.06 |
| Cyan Coupler (ExC-1) | 0.16 |
| Cyan Coupler (ExC-2) | 0.13 |
| Dye Image Stabilizer (Cpd-6) | 0.32 |
| Dye Image Stabilizer (Cpd-7) | 0.18 |
| Solvent (Solv-4) | 0.10 |
| Solvent (Solv-5) | 0.10 |
| Solvent (Solv-6) | 0.11 |
| 6th Layer: Ultraviolet Absorbing Layer | |
| Gelatin | 0.48 |
| Ultraviolet Absorber (UV-1) | 0.18 |
| Solvent (Solv-4) | 0.08 |
| 7th Layer: Protective Layer | |
| Gelatin | 1.33 |
| Acryl-Modified Copolymer of Polyvinyl Alcohol (modification degree: 17%) | 0.05 |
| Liquid Paraffin | 0.03 |

Yellow Coupler (ExY)

-continued
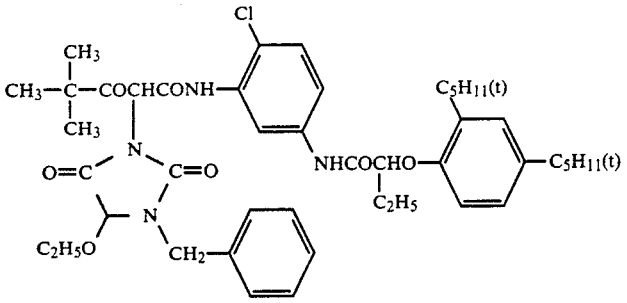
Magenta Coupler (ExM-1)
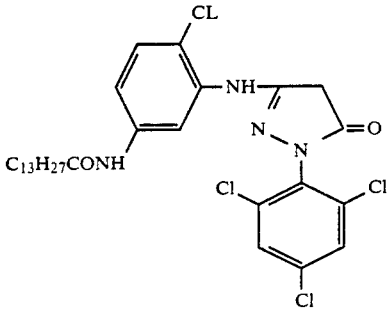
Cyan Coupler (ExC-1)
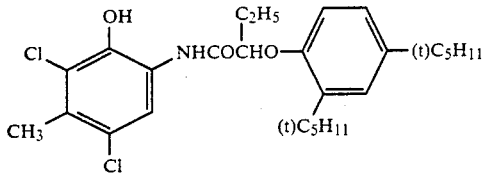
Cyan Coupler (ExC-2)
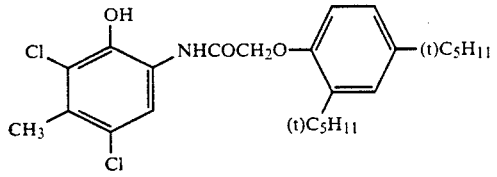
Color Mixing Preventing Agent (Cpd-1)
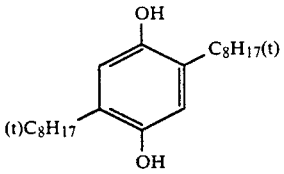
Dye Image Stabilizer (Cpd-2)
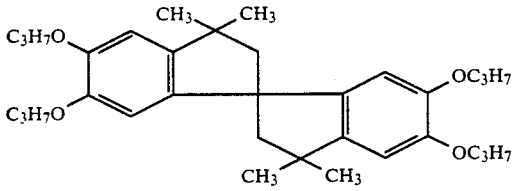
Dye Image Stabilizer (Cpd-3)

-continued
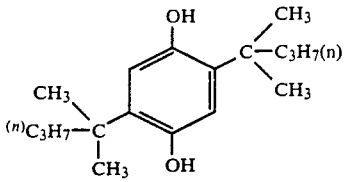
Dye Image Stabilizer (Cpd-4)
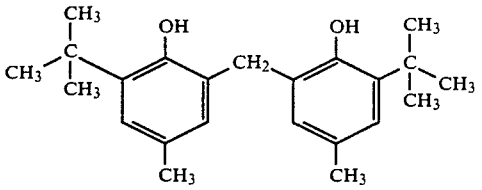
Dye Image Stabilizer (Cpd-5)
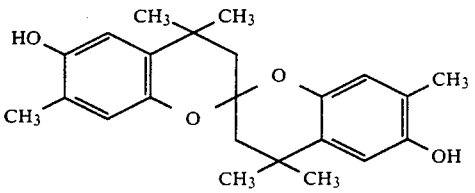
Dye Image Stabilizer (Cpd-6)
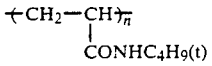
Number average molcular weight: 60,000
Dye Image Stabilizer (Cpd-7)
4:2:5 mixture (by weight) of:
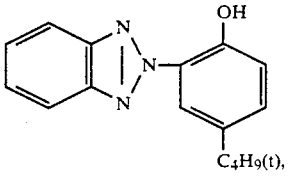
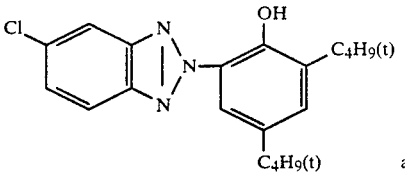
and
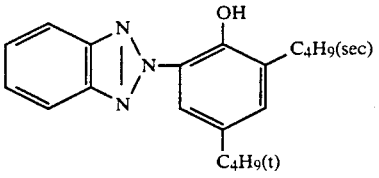
Ultraviolet Absorber (UV-1)
12:10:3 mixture (by weight) of:
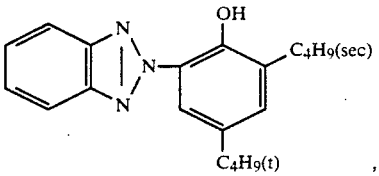

-continued

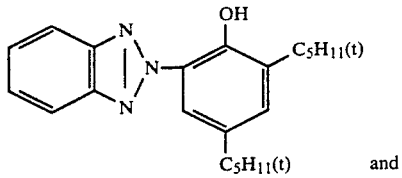

and

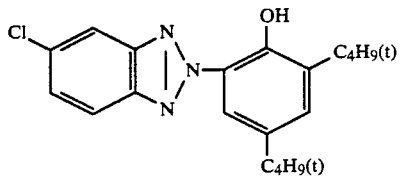

Solvent (Solv-1)

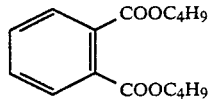

Solvent (Solv-2)

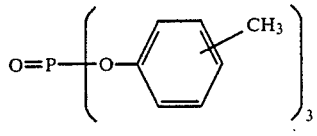

Solvent (Solv-3)

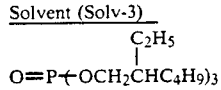

Solvent (Solv-4)

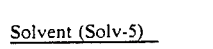

Solvent (Solv-5)

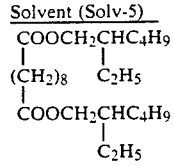

Solvent (Solv-6)

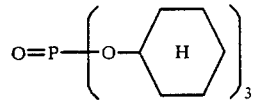

Dye (T-1)

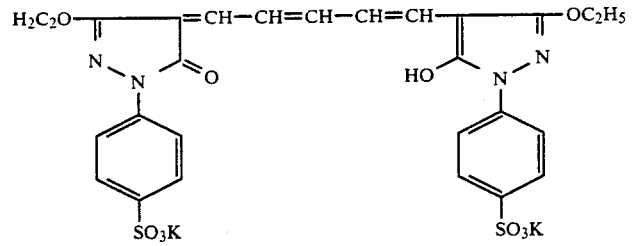

Thus, Specimen 101 was prepared. Specimens 102 to 116 were then prepared in the same manner as Specimen 101 except that the silver chloride content of the silver halide emulsion, the titanium oxide content of the support, and the type and added amount of the dye to be incorporated in the 2nd layer were altered as shown in Table 1.

Specimens 101 to 116 thus prepared were then subjected to gradient exposure for sensitometry through a separation filter by means of a sensitometer (Model FWH, manufactured by Fuji Photo Film Co., Ltd.; color temperature of light source: 3,200° K.). The exposure to light was conducted for 0.1 second in such a manner that the exposure reached 250 CMS.

These specimens were also exposed to light through a sharpness optical wedge in such a manner that the yellow, magenta and cyan densities each reached 1.5.

After exposure to light, these specimens were then subjected to the following processing:

| Processing Step | Temperature (°C.) | Time (sec) |
|---|---|---|
| Color Development | 35 | 45 |
| Blix | 30–35 | 45 |
| Rinse 1 | 30–35 | 20 |
| Rinse 2 | 30–35 | 20 |
| Rinse 3 | 30–35 | 20 |
| Rinse 4 | 30–35 | 30 |
| Drying | 70–80 | 60 |

The rinse was effected in a countercurrent process wherein the water flows from a tank 4 to a tank 1 through tanks 3 and 2.

The composition of the various processing solutions will be described hereinafter.

| | |
|---|---|
| Color Developing Solution: | |
| Water | 800 ml |
| Ethylenediamine-N,N,N,N-tetramethylene-phosphonic Acid | 1.5 g |
| Triethylenediamine(1,4-diazabicyclo[2,2,2]-octane | 5.0 g |
| Sodium Chloride | 1.4 g |
| Potassium Carbonate | 25 g |
| N-Ethyl-N-(β-methanesulfonamidoethyl)-3-methyl-4-aminoaniline Sulfate | 5.0 g |
| N,N-Diethylhydroxylamine | 4.2 g |
| Fluorescent Brightening Agent (UVITEX CK, Ciba Geigy) | 2.0 g |
| Water to make | 1,000 ml |
| pH at 25° C. | 10.10 |
| Blix Solution: | |
| Water | 400 ml |
| Ammonium Thiosulfate (70% aq. soln.) | 100 ml |
| Sodium Sulfite | 18 g |
| Iron(III) Ammonium Ethylenediaminetetra-acetate | 55 g |
| Disodium Ethylenediaminetetraacetate | 3 g |
| Ammonium Bromide | 40 g |
| Glacial Acetic Acid | 8 g |
| Water to make | 1,000 ml |
| pH at 25° C. | 5.5 |

Rinse Solution

Ion-exchanged water (calcium and magnesium concentration: 3 ppm each)

TABLE 1

| Specimen No. | Silver Chloride Content B* (mol %) | G* (mol %) | R* (mol %) | $TiO_2$ Content ($g/m^2$) | Dye ($mg/m^2$) | Remarks |
|---|---|---|---|---|---|---|
| 101 | 99 | 99 | 98.2 | 2.7 | T-1 (20) | Comparison |
| 102 | 50 | 50 | 50 | 2.7 | T-1 (2) | " |
| 103 | 99 | 99 | 98.2 | 2.7 | T-1 (1.5) | " |
| 104 | 99 | 99 | 98.2 | 3.5 | T-1 (20) | " |
| 105 | 99 | 99 | 98.2 | 3.5 | T-1 (1.5) | " |
| 106 | 99 | 99 | 98.2 | 3.5 | 10 (20) | Invention |
| 107 | 99 | 99 | 98.2 | 3.5 | 12 (20) | " |
| 108 | 99 | 99 | 98.2 | 3.5 | 13 (20) | " |
| 109 | 99 | 99 | 98.2 | 3.5 | 19 (20) | " |
| 110 | 99 | 99 | 98.2 | 3.5 | 42 (20) | " |
| 111 | 99 | 99 | 98.2 | 4.5 | 10 (20) | " |
| 112 | 99 | 99 | 98.2 | 4.5 | 13 (20) | " |
| 113 | 99 | 99 | 98.2 | 2.7 | 10 (20) | Comparison |
| 114 | 99 | 99 | 98.2 | 2.7 | 10 (30) | " |
| 115 | 99 | 99 | 98.2 | 2.7 | 13 (20) | " |
| 116 | 99 | 99 | 98.2 | 2.7 | 13 (30) | " |

B* indicates a blue-sensitive silver halide emulsion layer,
G* indicates a green-sensitive silver halide emulsion layer, and
R* indicates a red-sensitive silver halide emulsion layer.

These specimens thus processed were then subjected to sensitometry to determine the maximum density (Dm) of the blue-sensitive emulsion layer. Thus, the rapid processability of these specimens was evaluated. These specimens were also measured for reflection density of unexposed portions (background) at 650 nm to evaluate the degree of color stain by residual dye. These specimens were further evaluated for sharpness of the blue-sensitive emulsion layer. The sharpness is represented by C.T.F. (%) of the red-sensitive emulsion layer at a spatial frequency of 10 lines/mm. The greater the value of C.T.F. is, the better is the sharpness.

The results of these evaluations are shown in Table 2.

TABLE 2

| Specimen No. | Dm of Blue-Sensitive Layer | Color Stain (650 nm) | Sharpness (R) | Remarks |
|---|---|---|---|---|
| 101 | 2.23 | 0.14 | 50 | Comparison |
| 102 | 1.15 | 0.15 | 48 | " |
| 103 | 2.21 | 0.04 | 27 | " |
| 104 | 2.25 | 0.14 | 54 | " |
| 105 | 2.26 | 0.04 | 36 | " |
| 106 | 2.25 | 0.06 | 60 | Invention |
| 107 | 2.27 | 0.06 | 59 | " |
| 108 | 2.28 | 0.06 | 61 | " |
| 109 | 2.26 | 0.06 | 60 | " |
| 110 | 2.27 | 0.07 | 61 | " |
| 111 | 2.34 | 0.06 | 64 | " |
| 112 | 2.32 | 0.06 | 65 | " |
| 113 | 2.28 | 0.06 | 51 | Comparison |
| 114 | 2.26 | 0.08 | 57 | " |
| 115 | 2.25 | 0.06 | 52 | " |
| 116 | 2.27 | 0.08 | 58 | " |

Table 2 shows that the specimens comprising a silver halide emulsion having a low silver chloride content exhibit a low rate of development, making it impossible to provide a sufficient maximum density in a short processing time. On the other hand, the specimens comprising a silver halide emulsion having a high silver chloride content can provide a sufficient maximum density even when processed for as short a period of time as 45 seconds.

In connection with color stain and sharpness, Specimen 101 and Specimen 102 comprising antiirradiation dye in an amount of 20 mg/m$^2$ exhibit an extremely great color stain which deteriorates photographic properties and Specimen 103 comprising a dye in an amount of 1.5 mg/m$^2$ exhibits no color stain but shows an extremely poor sharpness. Specimen 103 cannot recover its sharpness even when its support is replaced by the present support having a titanium oxide content of 3.0 g/m$^2$ or more.

On the other hand, the specimens comprising the present dye of formula (I) exhibit little color stain even if they comprise the dye in an amount of 20 mg/m$^2$. The present constitution, i.e., combination of such a dye and a support having a titanium oxide content of 3.0 g/m$^2$ or more can provide an extremely high sharpness.

EXAMPLE 2

Specimen 201 was prepared in the same manner as in Example 1 except that the compositions of the 2nd layer (color mixing preventing layer), the 3rd layer (green-sensitive layer) and the 5th layer (red-sensitive layer) were replaced by those described hereinafter.

| | |
|---|---|
| 2nd Layer: Color Mixing Preventing Layer | |
| Gelatin | 0.89 |
| Color Mixing Preventing Agent (Cpd-1) | 0.08 |
| Solvent (Solv-1) | 0.20 |
| Solvent (Solv-2) | 0.20 |
| Dye (T-1) | 0.02 |
| Dye (T-2) | 0.013 |
| 3rd Layer: Green-Sensitive Layer | |
| Silver Halide Emulsion (2) | 0.14 |
| Gelatin | 1.30 |
| Magenta Coupler (ExM-2) | 0.27 |
| Dye Image Stabilizer (Cpd-2) | 0.16 |
| Stain Inhibitor (Cpd-8) | 0.025 |
| Stain Inhibitor (Cpd-9) | 0.032 |
| Solvent (Solv-2) | 0.21 |
| Solvent (Solv-3) | 0.33 |
| 5th Layer: Red-Sensitive Layer | |
| Silver Halide Emulsion (3) | 0.22 |
| Gelatin | 1.06 |
| Cyan Coupler (ExC-1) | 0.16 |
| Cyan Coupler (ExC-3) | 0.19 |
| Dye Image Stabilizer (Cpd-6) | 0.32 |
| Dye Image Stabilizer (Cpd-7) | 0.18 |
| Solvent (Solv-4) | 0.12 |
| Solvent (Solv-5) | 0.12 |

Magenta Coupler (ExM-2)

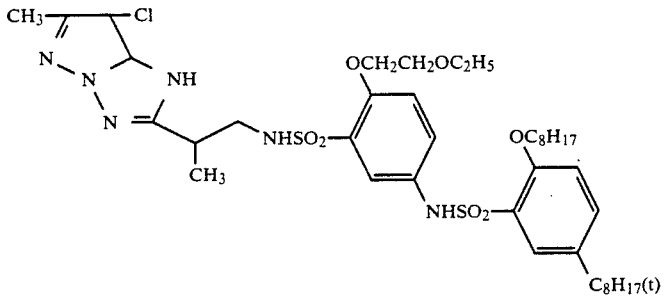

Stain Inhibitor (Cpd-8)

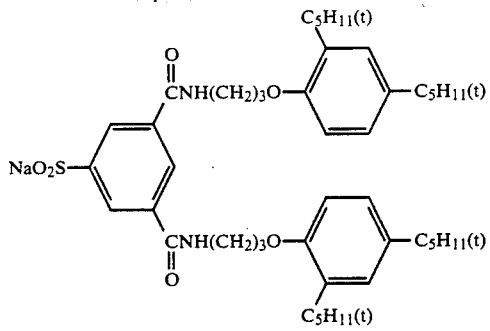

Stain Inhibitor (Cpd-9)

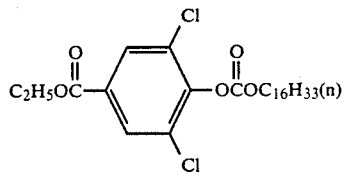

Cyan Coupler (ExC-3)

-continued

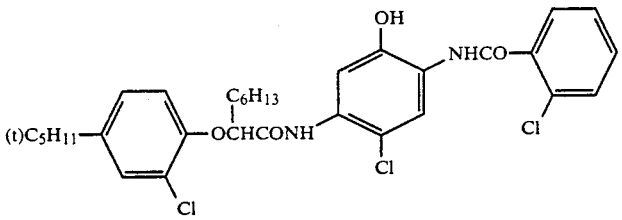

Dye (T-2)

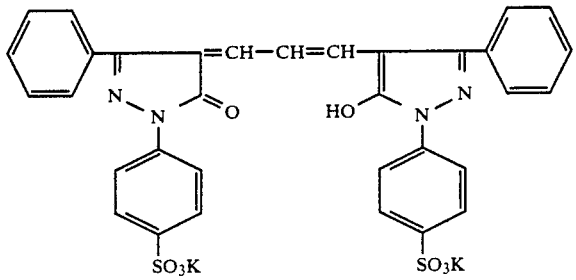

Specimens 202 to 208 were then prepared in the same manner as Specimen 201 except that the titanium oxide content of the support and the type and added amount of the dye to be incorporated in the 2nd layer were altered as shown in Table 3.

TABLE 3

| Specimen No. | $TiO_2$ Content ($g/m^2$) | Dye ($mg/m^2$) | Remarks |
|---|---|---|---|
| 201 | 2.7 | T-1 (20)<br>T-2 (13) | Comparison |
| 202 | 2.7 | T-1 (1.5)<br>T-2 (1.0) | " |
| 203 | 3.5 | T-1 (1.5)<br>T-2 (1.0) | " |
| 204 | 3.5 | 10 (20)<br>7 (13) | Invention |
| 205 | 3.5 | 13 (20)<br>43 (13) | " |
| 206 | 3.5 | 54 (20)<br>5 (13) | " |
| 207 | 4.5 | 13 (20)<br>43 (13) | " |
| 208 | 2.7 | 13 (30)<br>43 (25) | Comparison |

Specimens 201 to 208 thus prepared were then evaluated for color stain and sharpness in the same manner as in Example 1. The color stain is represented by reflection density of the background at 550 nm and 650 nm. The sharpness is represented by C.T.F. (%) of the green-sensitive emulsion layer and the red-sensitive emulsion layer at a spatial frequency of 10/mm.

The results of these evaluations are shown in Table 4.

TABLE 4

| Specimen No. | Color Stain 550 nm | Color Stain 650 nm | Sharpness G | Sharpness R | Remarks |
|---|---|---|---|---|---|
| 201 | 0.10 | 0.14 | 53 | 50 | Comparison |
| 202 | 0.04 | 0.04 | 33 | 30 | " |
| 203 | 0.04 | 0.04 | 40 | 38 | " |
| 204 | 0.06 | 0.06 | 65 | 61 | Invention |
| 205 | 0.06 | 0.06 | 65 | 60 | " |
| 206 | 0.06 | 0.06 | 64 | 61 | " |
| 207 | 0.06 | 0.06 | 66 | 65 | " |
| 208 | 0.07 | 0.08 | 58 | 56 | Comparison |

Table 4 shows that the present specimens comprising the dye of formula (I) exhibit little color stain and provide an extremely high sharpness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising photographic constituent layers containing at least one light-sensitive silver halide emulsion layer and at least one light-insensitive layer on a reflective support, wherein at least one of said photographic constituent layers comprises at least one dye represented by formula (I), at least one of said light-sensitive silver halide emulsion layers comprises silver halide grains substantially comprising cubic silver chlorobromide having a silver chloride content of 95 mol % or more and said reflective support comprises 3.0 $g/m^2$ or more of titanium oxide:

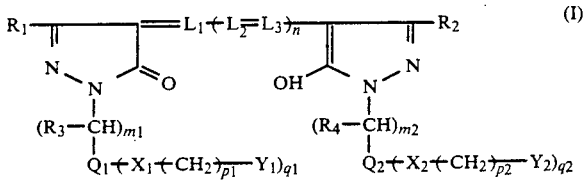

(I)

wherein $R_1$ and $R_2$ each represents an alkyl group, an aryl group, a cyano group, $—COOR_5$, $—CONR_5R_6$, $—COR_7$, $—SO_2R_7$, $—SOR_7$, $—SO_2NR_5R_6$, $—OR_5$, $—NR_5R_6$, $—NR_6COR_7$, $—NR_5CONR_5R_6$ or $—NR_6SO_2R_7$ in which $R_5$ and $R_6$ each represents a hydrogen atom, an alkyl group or an aryl group, $R_7$ represents an alkyl group or an aryl group, and $R_5$ and $R_6$ or $R_6$ and $R_7$ may be connected to each other to form a 5- or 6-membered ring; $R_3$ and $R_4$ each represents a hydrogen atom; $Q_1$ and $Q_2$ each represents a phenyl group; $X_1$ and $X_2$ each represents a bond or divalent connecting group; $Y_1$ and $Y_2$ each represents a sulfo group or a carboxyl group; $L_1$, $L_2$ and $L_3$ each represents a substituted or unsubstituted methine group; n represents an integer 0, 1 or 2; $m_1$ and $m_2$ each represents an integer 1; $p_1$ and $p_2$ each represents an integer 0, 1, 2, 3, or 4; and $q_1$ and $q_2$ each represents an integer 1, 2 or 3.

2. The silver halide color photographic material as claimed in claim 3, wherein the silver halide grains substantially comprising silver chloride are silver chlorobromide having a silver chloride content of 98 mol % or more.

3. The silver halide color photographic material as claimed in claim 1, wherein in the dye represented by formula (I), $R_3$ and $R_4$ each represents a hydrogen atom, $Q_1$ and $Q_2$ each represents a phenyl group, and $X_1$ and $X_2$ each represents a bond or —O— or —$NR_8$— in which $R_8$ represents a hydrogen atom, an alkyl group containing 5 or less carbon atoms or a substituted alkyl group containing 5 or less carbon atoms.

4. The silver halide color photographic material as claimed in claim 3, wherein in the dye represented by formula (I), and $R_1$ and $R_2$ each represents an alkyl group, an aryl group, a cyano group, —$COOR_5$, —$CONR_5R_6$, —$COR_7$, —$SO_2R_7$, —$SO_2NR_5R_6$, or —$NR_6SO_2R_7$ in which $R_5$, $R_6$ and $R_7$ each has the same meaning as defined in formula (I).

5. The silver halide color photographic material as claimed in claim 1, wherein the reflective support comprises 4.0 g/m$^2$ or more of titanium oxide.

6. The silver halide color photographic material as claimed in claim 3, wherein the content of the titanium oxide is from 4.0 g/m$^2$ to 10.0 g/m$^2$.

7. The silver halide color photographic material as claimed in claim 1, wherein the content of the dye represented by formula (I) is from 2 mg/m$^2$ to 40 mg/m$^2$.

8. The silver halide color photographic material as claimed in claim 1, wherein the photographic constituent layers contain a silver halide emulsion layer containing a yellow coupler, a silver halide emulsion layer containing a magenta coupler and a silver halide emulsion layer containing a cyan coupler, and each of the silver halide emulsion layers contains a silver halide emulsion having an average silver chloride content of 95 mol % or more.

9. The silver halide color photographic material as claimed in claim 8, wherein each of the silver halide emulsion layers contains a silver chlorobromide emulsion having an average silver chloride content of 98 mol % or more.

10. The silver halide color photographic material as claimed in claim 8, wherein each of the silver halide emulsion layers comprises a monodispersed silver halide emulsion in which 95% or more of the total silver halide grains fall within ±40% of the average particle size as calculated by the weight or number of grains.

* * * * *

UNITED STATES PATENT AND TRADEMARK OFFICE

CERTIFICATE OF CORRECTION

PATENT NO. : 5,035,986

DATED : July 30, 1991

INVENTOR(S) : Sakai et al

It is certified that error appears in the above-identified patent and that said Letters Patent is hereby corrected as shown below:

On the title page please insert item (30):

Foreign Application Priority Data

Jan. 28, 1988 [JP] Japan.....63-017772--.

Signed and Sealed this

Twenty-seventh Day of October, 1992

*Attest:*

DOUGLAS B. COMER

*Attesting Officer*

*Acting Commissioner of Patents and Trademarks*